US006261386B1

(12) United States Patent
Perepezko et al.

(10) Patent No.: US 6,261,386 B1
(45) Date of Patent: Jul. 17, 2001

(54) NANOCRYSTAL DISPERSED AMORPHOUS ALLOYS

(75) Inventors: John H. Perepezko, Madison, WI (US); Donald R. Allen, Rochester Hills, MI (US); James C. Foley, Nevada, IA (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 09/171,749

(22) PCT Filed: Jun. 30, 1998

(86) PCT No.: PCT/US98/13596

§ 371 Date: Oct. 21, 1998

§ 102(e) Date: Oct. 21, 1998

(87) PCT Pub. No.: WO99/00523

PCT Pub. Date: Jan. 7, 1999

Related U.S. Application Data

(60) Provisional application No. 60/051,202, filed on Jun. 30, 1997.

(51) Int. Cl.[7] ..... C22C 45/00

(52) U.S. Cl. ..... 148/302; 148/305; 148/403; 148/437

(58) Field of Search ..... 148/302, 305, 148/403, 437, 561, 121

(56) References Cited

U.S. PATENT DOCUMENTS

| | | | | |
|---|---|---|---|---|
| 4,416,709 | * | 11/1983 | Ohya et al. | 148/403 |
| 4,470,723 | * | 9/1988 | Sagawa et al. | 148/302 |
| 4,495,691 | | 1/1985 | Masumoto et al. | 29/527.5 |
| 4,523,626 | | 6/1985 | Masumoto et al. | 164/463 |
| 4,668,310 | * | 5/1987 | Kudo et al. | 148/403 |
| 4,735,864 | | 4/1988 | Masumoto et al. | 428/606 |
| 4,909,867 | | 3/1990 | Masumoto et al. | 148/403 |
| 4,911,767 | | 3/1990 | Masumoto et al. | 148/403 |
| 4,950,452 | | 8/1990 | Masumoto et al. | 420/550 |
| 5,032,196 | | 7/1991 | Masumoto et al. | 148/403 |
| 5,053,084 | | 10/1991 | Masumoto et al. | 148/11.5 A |
| 5,074,935 | | 12/1991 | Masumoto et al. | 148/403 |
| 5,122,205 | | 6/1992 | Masumoto et al. | 148/403 |
| 5,198,042 | | 3/1993 | Masumoto et al. | 148/403 |
| 5,209,791 | | 5/1993 | Masumoto et al. | 148/561 |
| 5,213,148 | | 5/1993 | Masumoto et al. | 164/122 |
| 5,240,517 | | 8/1993 | Masumoto et al. | 148/403 |
| 5,288,344 | | 2/1994 | Peker et al. | 148/403 |
| 5,296,059 | | 3/1994 | Masumoto et al. | 148/695 |
| 5,466,308 | * | 11/1995 | Fujimura et al. | 148/302 |
| 5,611,871 | * | 3/1997 | Yoshizawa et al. | 148/121 |
| 5,714,018 | * | 2/1998 | Kita et al. | 148/415 |
| 6,019,859 | * | 2/2000 | Kanekiyo et al. | 148/302 |

OTHER PUBLICATIONS

Foley, J. et al., "Formation of Nanocrystalline Aluminum in Al–Y–FE Amorphous Alloys", *Materials Science Forum*, vols. 225–227 (1996) pp. 323–328.

Foley, J. et al., "Analysis of Nanocrystal Development in Al–Y–Fe and Al–Sm Glasses", *Scripta Materialia*, vol. 35, No. 5, pp. 655–660, 1990.

Yeum, K. et al., "Estimation of the Surface Tensions of Binary Liquid Alloys", *Metallurgical Transactions B*, vol. 20B, Oct. 1989, pp. 693–703.

(List continued on next page.)

*Primary Examiner*—George Wyszomierski
(74) *Attorney, Agent, or Firm*—Fulbright & Jaworski

(57) ABSTRACT

Compositions and methods for obtaining nanocrystal dispersed amorphous alloys are described. A composition includes an amorphous matrix forming element (e.g., Al or Fe); at least one transition metal element; and at least one crystallizing agent that is insoluble in the resulting amorphous matrix. During devitrification, the crystallizing agent causes the formation of a high density nanocrystal dispersion. The compositions and methods provide advantages in that materials with superior properties are provided.

7 Claims, 19 Drawing Sheets

OTHER PUBLICATIONS

He, Y. et al., "Unique Metallic Glass Formability and Ultra–High Tensile Strength in Al–Fe–Gd Alloys", *Acta metall. mater.*, vol. 41, No. 2, pp. 337–343 (1993).
Inoue, A. et al. "Light–metal base amorphous alloys containing lanthanide metal", *Journal of Alloys and Compounds*, vols. 207/208, pp. 340–348 (1994).
Makino, A. et al., "Magnetic properties and core losses of nanocrystalline Fe–M–B (M≡Zr, Hf or Nb) alloys", *Materials Science and Engineering*, (1994) pp. 127–131.
Higashi, K. et al., "Very Fine Grains and Very High Strain Rate Superplasticity in Aluminum–Based Alloys Produced from Amorphous Powders", *Materials Science Forum*, vols. 113–115 (1993), pp. 231–236.
Masumoto, T., "Recent Progress of Amorphous Metallic Materials", *Sci. Rep. RITU*, (1994), pp. 91–102.
Diego, J. et al., "Thermodynamic, kinetic and structural mechanisms controlling the formation of nanocrystalline Nd–Fe–B materials", *Materials Science and Engineering*, (1994), pp. 526–530.
Choi, G. et al., "Ultrahigh Tensile Strength of Amorphous Al–Ni–(Nd,Gd)–Fe Alloys Containing Nanocrystalline Al Particles", *Scripta Metallurgica et Materials*, vol. 33, No. 8, pp. 1301–1306 (1995).
Inoue, A. et al., "Fe–Based Ferromagnetic Glassy Alloys with Wide Supercooled Liquid Region", *Materials Transactions JIM*, vol. 36, No. 9, pp. 1180–1183 (1995).
Koster, U. et al., "Phase Transformations in Rapidly Solidified Alloys", *Rapidly Solidified Alloys*, Liebermann, H. (Ed.), Marcel Dekker, Inc., New York, pp. 310–315.
Iida, T. et al., "The Physical Properties of Liquid Metals", Clarendon Press, Oxford, 1993, pp. 135–147.
Suzuki, K. et al., "Changes in Microstructure and Soft Magnetic Properties of an $Fe_{86}Zr_7B_6Cu_1$ Amorphous Alloy upon Crystallization", *Materials Transactions, JIM*, vol. 32, No. 10 (1991), pp. 961–968.
Inoue, A., "High Strength Bulk Amorphous Alloys with Low Critical Cooling Rates (Overview)", *Materials Transactions, JIM*, vol. 36, No. 7 (1995), pp. 866–875.
Makino, A. et al., "Low Core Loss of a bcc $Fe_{86}Zr_7B_6Cu_1$ Alloy with Nanoscale Grain Size", *Materials Transactions, JIM*, vol. 32, No. 6 (1991), pp. 551–556.
Inoue, A., "Nanocrystalline Soft Magnetic Alloys with Zero Magnetostrict Ion In Fe–Zr–Al and Fe–Zr–Si Base Systems", *Mat. Sci. Forum*, vols. 225–227, p. 639 (1996).
Muller, K. et al., "TEM investigation of crystallization phenomena in the metallic glass Vitrovac 0400 ($Fe_{40}Ni_{40}B_{20}$)", *Journal of Materials Science*, vol. 17 (1982), pp. 2525–2532.
Tiwari, S. et al., "TEM of the Kinetics of Crystallization of Metglas 2826", *Z. Metallkde*, vol. 72 (1981) H.8, pp. 563–568.
Battezzati, L. et al., "Kinetics of Formation and Thermal Stability of Fe–X–B Metallic Glasses", Journal of Non–Crystalline Solids, vol. 89 (1987), pp. 114–130.
Inoue, A. et al., "Microstructure and Soft Magnetic Properties of Nanocrystalline Fe–Zr–B–Al, Fe–Zr–B–Si and Fe–Zr–B–Al–Si Alloys with Zero Magnetostriction", *Materials Transactions, JIM*, vol. 37, No. 1 (1996), pp. 78–88.
Inoue, A. et al., "Glass–forming ability of alloys", pp. 476–480.
Foley, James C., "Rapid Solidification Processing of Aluminum–Rare Earth Alloys", dissertation for Ph.D. (Metallurgical Engineering) submitted to University of Wisconsin—Madison, (1997), 257 pages.

* cited by examiner

Al–7 at. % Y–5 at. % Fe Melt Spun Ribbon
Anneal 275°C, 10 minutes

Continuous DTA thermogram of Fe-7Zr-3B and Fe-7Nb-9B as-cast MSR by Inoue.

NANOCRYSTAL DISPERSED AMORPHOUS ALLOYS

This application is a 371 of PCT/US98/13596, filed Jun. 30, 1998 and claims benefit of provisional application No. 60/051,202, filed Jun. 30, 1997.

This invention was made with United States government support awarded by the following agencies:

AFOSR Grant No.: F4962096-1-0286

NASA Grant Nos.: NGT-51190; NGT-51133; NAGW-2841

ONR Grant Nos.: N0001492-J-1554; DAAH04-93-G-0296; DAAH04-93-6-0381

NSF Grant Nos.: DMR-9308148; ASC-9310310

NASA Grant Nos.: NAG8-1278; NAG8-1068.

The United States has certain rights in this invention.

BACKGROUND OF THE INVENTION

1. Field of the Invention

The present invention relates generally to the field of amorphous alloys. More particularly, the present invention relates to amorphous alloys and alloy structures obtained by controlled crystallization. Specifically, a preferred implementation of the present invention relates to alloys with high number density nanocrystal dispersions that are seeded with an element that is added to the amorphous matrix but that is insoluble therewith. The present invention thus relates to amorphous alloys of the type that can be termed nanocrystal dispersed.

2. Discussion of the Related Art

Historically, rapid solidification processing has yielded amorphous structures in numerous metallic alloy systems. The development of nanocrystalline materials through the partial recrystalization (devitrification) of amorphous precursors has recently received considerable attention.

A first class of amorphous metallic materials that shows particular promise for commercial applications consists of aluminum (Al) glasses that include transition metal (TM) and rare earth (RE) elements. These aluminum glasses possess exceptional strength combined with good ductility and corrosion resistance. These Al-TM-RE glasses typically contain greater than 75 atomic percent (at. %) aluminum. These Al-TM-RE glasses offer an alternative to traditional crystalline materials for some structural applications.

A second class of amorphous metallic materials that shows particular promise for commercial applications consists of iron (Fe) glasses that include transition metal (TM) and rare earth (RE) elements together with boron (B). These iron glasses possess good magnetic properties for electrical applications. These Fe-TM-RE-B glasses typically contain greater than 70 at. % iron.

Those of skill in the art of materials know that changing the size and density of nanocrystals that are produced during initial devitrification can alter the properties of both of these classes of amorphous metallic materials. The controlled crystallization of these alloys is a challenge, as the prior art alloying and heat treatment techniques have remained strictly empirical. Heretofore, there has been no effective approach to precisely and accurately control the number density or dispersion of nanocrystals in an amorphous matrix.

Within this application several publications are referenced by Arabic numerals within brackets. Full citations for these, and other, publications may be found at the end of the specification immediately preceding the claims. The disclosures of all these publications in their entireties are hereby expressly incorporated by reference into the present application for the purposes of indicating the background of the present invention and illustrating the state of the art.

SUMMARY OF THE INVENTION

Thus, there is a need for a phase separation technique that yields a high number density distribution of fine scale discrete particles in an amorphous matrix. Further, there is a particular need for a technique that yields a predictable and reproducible dispersion of such particles. The particles are used as nucleation sites for nanocrystal formation during subsequent devitrification. The characteristics of the resulting amorphous alloy are a function of the characteristics of the nanocrystals and the characteristics of the nanocrystals are a function of the characteristics of the particle dispersion. Unexpected beneficial effects of the present invention, which are substantial improvements over the prior art, include higher strength in the case of aluminum based amorphous alloys, and in the case of iron based amorphous alloys, better magnetic properties.

These, and other, aspects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore nonlimiting, embodiments illustrated in the drawings accompanying and forming a part of this specification, wherein like reference numerals designate the same elements in the several views. It should be noted that the features illustrated in the drawings are not necessarily drawn to scale.

DESCRIPTION OF PREFERRED EMBODIMENTS

Figure 1:
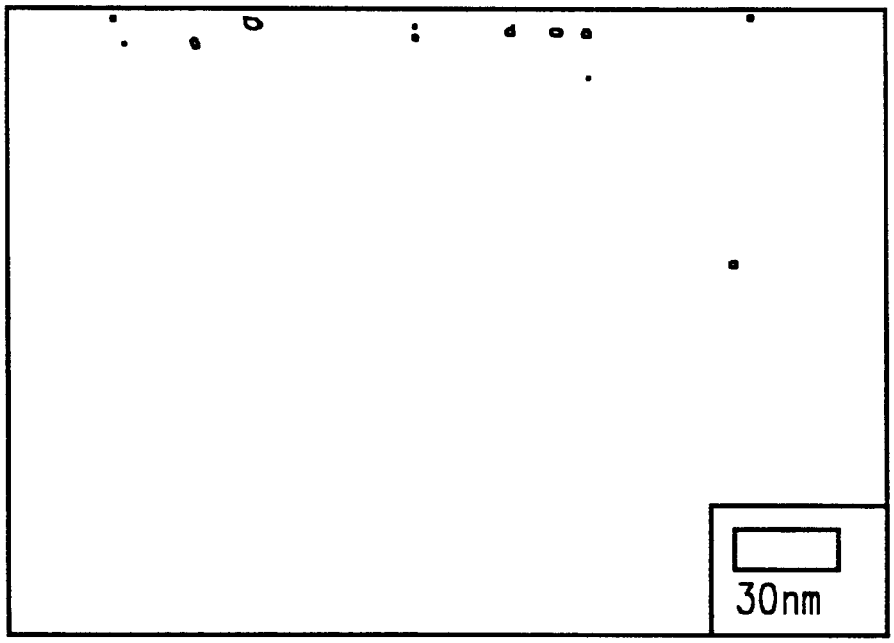
FIG. 1 illustrates a transmission electron micrograph of a sample of an Al—7Y—5Fe—1Pb alloy in an as-spun (quenched) condition, representing an embodiment of the present invention.

The present invention and the various features and advantageous details thereof are explained more fully with reference to the nonlimiting embodiments that are illustrated in the accompanying drawings and detailed in the following description. Descriptions of well-known materials and processing techniques are omitted so as to not unnecessarily obscure the present invention in detail.

Overview

An amorphous precursor typically has many potential decomposition reaction pathways available. The desired reaction pathway usually includes the development of a terminal, face-centered-cubic (fcc) solid solution phase for Al-TM-RE glasses or a terminal, body-centered-cubic (bcc) solid solution phase for Fe-TM-RE-B glasses.

It should be noted that the development of intermetallic phases is possible for both Al-TM-RE and Fe-TM-RE-B glasses. While in some cases intermetallic phases may be desired, intermetallic phases are often brittle and are, therefore, generally undesirable.

The addition of elements that are not soluble in the amorphous precursor, but do not affect glass formability, can provide dispersed particles (nucleation sites) for nanocrystal growth during subsequent thermal cycling. Optimizing the initial size, density and dispersion of the nucleation sites (i.e., the insoluble element phase) directly effects the size and density of the subsequently formed nanocrystals, thereby altering the properties of the resultant amorphous alloy. This provides for a level of control over the properties of amorphous alloys that is not possible in the prior art.

Moreover, the insoluble particle phase(s) (i.e., the dispersed nucleation sites) is (are) crystalline. This permits relatively easy observation of the dispersed nucleation sites with standard electron microscopy techniques. For example, the particles can be easily detected with transmitting electron microscopy (TEM). The easy detection of these particles with TEM permits both enhanced quality control of the final amorphous alloy and "fingerprint" characterization of alloys prepared in accordance with the invention.

DETAILED DESCRIPTION OF PREFERRED EMBODIMENTS

One class of alloys disclosed herein can be created starting with an amorphous or glass-like aluminum alloy precursor composition. Lead is immiscible in such amorphous aluminum precursors. Therefore, it creates small crystals in the amorphous matrix. The amount of lead added determines the number and size of the small crystals. The addition of up to approximately 1 atomic percent (at. %) of lead, for example, does not appreciably effect the mass density. The resulting aluminum based alloys have high strength.

Other elements with similar properties to lead, such as, for example, bismuth, indium, and cadmium provide similar results. There are two rules for determining which elements may be substituted into the amorphous matrix for the purpose of the invention. The first rule is that the substituted element should be immiscible with the base amorphous precursor matrix. That is, since these elements are immiscible in liquid aluminum, they form discrete particles via a liquid phase separation process and thereby provide nucleation sites for the subsequent formation and dispersion of nanocrystalline aluminum during devitrification. The second rule is that the substituted element should not react with the solute rare earth or transition metals. That is, the formation of an additional intermetallic phase should be avoided.

The results obtained by the invention are surprising because lead ordinarily forms compounds with the transition and rare earth elements with which the aluminum is typically alloyed. Such compounding would defeat the formation of an amorphous glass. Instead, it is believed that there are two competing factors that determine the role of the lead. On the one hand, there is a driving force for the lead to form the above mentioned compounds. On the other hand, there is a driving force for the lead to avoid (i.e., phobic) the other components of the amorphous matrix.

The possible compounds or alloys with which the invention is useful are many and varied. In the case of aluminum based alloys, the aluminum can compose from approximately 75 at. % to approximately 95 at. %, preferably from approximately 85 at. % to approximately 92 at. %. The transition metal elements that are usable with the aluminum based amorphous materials include iron, nickel, cobalt, manganese, copper, titanium, silver, and palladium, the amount of transition metal element in the aluminum based amorphous matrix can compose from approximately 1 at. % to approximately 15 at. % so as to not extend beyond the range of primary crystallization In preferred embodiments, the amount of transition metal element in the aluminum based amorphous matrix can be from approximately 2 at. % to approximately 10 at %, more preferably from approximately 4 at. % to approximately 7 at. %.

The amount of rare earth element that can be included in the aluminum based amorphous precursors matrix can be from approximately 1 at. % to approximately 15 at. %, preferably from approximately 2 at. % to approximately 10 at. % more preferably, approximately 7 at. %. Among the rare earth elements suitable for use with the aluminum based amorphous matrix, the lanthanides: lanthanum, cerium, and yttrium, are preferred. The amount of crystallizing agent that can be incorporated into the amorphous precursor batch can vary from approximately 0.1 at. % to approximately 3 at. %, preferably from 0.1 at % to approximately 2 at. %, more preferably approximately 1 at. %. The crystallizing agent elements that can be used with the aluminum based amorphous precursor matrix include lead, bismuth, indium and cadmium. It will be appreciated that these are heavy metals chosen for their immiscibility gaps.

Optionally, a surfactant in an amount from approximately 0.1% to approximately 0.5% can be included to promote a fine scale liquid phase separation. Suitable elements include Tin, Calcium and other alkaline metals. It would be possible to use an ultrasonic wave to break up relatively large immiscibility particles or, alternatively, use a hydrogen atmosphere to promote a high nucleation density by creating internal surface pores.

The invention can be extended to iron based glass forming systems. Iron based glass forming systems are of considerable interest due to the magnetic properties of the resulting alloys. The dispersed nanocrystal strategy will work with a variety of iron based alloys to enhance both their hard and soft magnetic properties.

Amorphous iron alloy precursor compositions show similar liquid phase separation characteristics with lead. In the iron-based materials, the nanocrystal size, density and dispersion strongly effect the magnetic properties.

For example, in the case of Fe-TM-RE-B iron glass alloys, where TM=Zr, Hf, or Nb, good soft magnetic properties are obtained after partial crystallization. Other iron glass alloys, such as, for example, Fe—Nd—B, show good hard magnetic properties after partial crystallization.

The transition metals that are usable with the iron based amorphous matrices include the refractory metals, for example niobium, tantalum, and zirconium. As an alternative to boron, silicon can also be used. The nucleating agent elements usable with the iron based amorphous matrix precursors include lead, palladium, indium, copper, silver, and bismuth. Optionally, an agent such as phosphorous and/or carbon can be added to the iron based amorphous matrix precursor. The phosphorous or carbon can be added in an amount from approximately 0 at % to approximately 1.0 at. %. Phosphorous, carbon and silicon are all alternative nucleating agents for this purpose. Optionally, surface-active chlorides can be added to these iron based amorphous matrix precursor batches.

Hard magnetic materials suitable for use as permanent magnets can be based on iron, neodymium and boron. The neodymium can be added in an amount from approximately 5.0 at % to approximately 20 at %. The boron can be added in an amount from approximately 1.0 at. % to approximately 8 at %. The nucleating agent elements suitable for use with the permanent magnet materials include lead, palladium, indium, copper, silver and bismuth. As a flux, phosphorous can be added. Alternatively, a surface-active chloride can be added as a flux.

It is desirable to obtain a high density of nanocrystals. The key is to control the crystallization of the primary constituent of the amorphous matrix precursor batch. The amount and size scale of phase separation is a function of the quench rate. The amount of phase separation is also a function of the amount of immiscible element. The flux components are added to lower the surface tension between the lead and the aluminum. The aluminum nanocrystals are nearly perfect and have high strength. The resulting aluminum based alloy has strength equivalent to steel. Controlling the number of nanocrystals is difficult. Arc melting can be used to form an ingot. Alternatively, the lead or palladium can be added during melt spinning. Induction heating in a crucible causes rapid mixing. Stabilization is enhanced by having more sites because the diffusion fields overlap. There is a one to one correspondence between nanocrystals formed from the primary component of the matrix and the particles that are formed due to immiscibility.

The particular manufacturing process used for making the nanocrystal dispersed alloys should be inexpensive and reproducible. Conveniently, the method of the present invention can be carried out by using any fast cooling method. It is preferred that the process be automated. For the manufacturing operation, it is moreover an advantage to employ a melt-spun ribbon method.

However, the particular manufacturing process used for making the nanocrystal dispersed alloys is not essential to the present invention as long as it provides the described transformation. Normally the makers of the invention will select the manufacturing process based upon tooling and energy requirements, in view of the expected application requirements of the final product and the demands of the overall manufacturing process.

The particular material used for seeding (i.e., the crystallizing agent) should be insoluble in the precursor matrix. Conveniently, the crystallizing agent of the present invention can be based on any material that is insoluble in the corresponding amorphous precursor matrix. It is preferred that the material be nontoxic. For the manufacturing operation, it is moreover an advantage to employ a relatively inexpensive material.

However, the particular material selected for seeding the dispersed nanocrystals is not essential to the present invention, so long as it provides significant dispersion. Normally, the makers of the invention will select the best commercially available material based upon the economics of cost and availability, in view of the expected application requirements of the final product and the demands of the overall manufacturing process.

While not being limited to any particular performance indicator or diagnostic identifier, preferred embodiments of the present invention can be identified one at a time by testing for the presence of small seed particle sizes. While not being bound by theory, it is believed that large seed sizes can cause brittleness. The test for the presence of small seed particle sizes can be carried out without undue experimentation by the use of conventional TEM experiments. Among the other ways in which to seek embodiments having the attribute of high performance, guidance toward the next preferred embodiment can be based on the presence of large amounts (ie., high volume percent) of seed particles.

EXAMPLE

A specific embodiment of the present invention will now be further described by the following, nonlimiting example which will serve to illustrate in more detail various features of significance. The example is intended merely to facilitate an understanding of ways in which the present invention may be practiced and to further enable those of skill in the art to practice the present invention. Accordingly, the example should not be construed as limiting the scope of the present invention.

As a seed particle precursor, 1 at. % lead (Pb) was added to a batch of 87 at. % aluminum, 7 at. % yttrium, and 5 at. % iron (Al—7Y—5Fe). An amorphous ribbon was solidified from the resultant batch by free-jet melt spinning.

FIG. 1 shows a transmission electron micrograph of the as-solidified ribbon. It can be appreciated that the matrix is predominately an amorphous structure with discrete spherical regions of crystalline lead, the later having sizes in the range of from approximately 10 nm to approximately 60 nm. The volume fraction of Al particles is in excess of 10 volume percent (vol. %). The density of these lead particles is on the order of $10^{20}$ sites/$m^3$. Higher lead particle densities can be achieved by process optimization. The as-solidified ribbon was then thermally cycled. The cycling included 10 minutes dwell time at 290° C.

Figure 2:
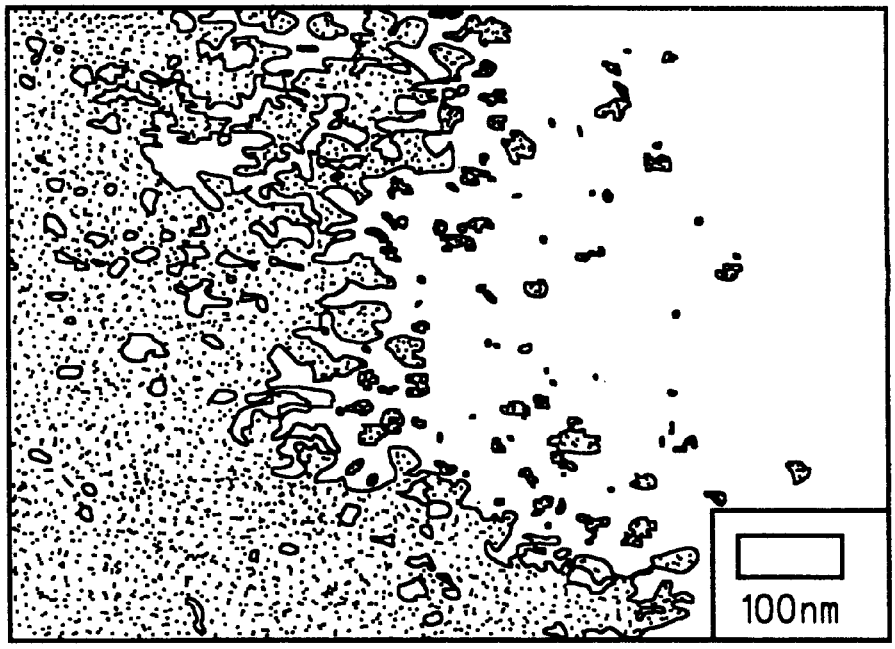
FIG. 2 illustrates a transmission electron micrograph of a sample of an Al—7Y—5Fe—1Pb alloy after a subsequent step of isothermal annealing at 290° C. for 10 minutes, representing an embodiment of the present invention.
Figure 3:
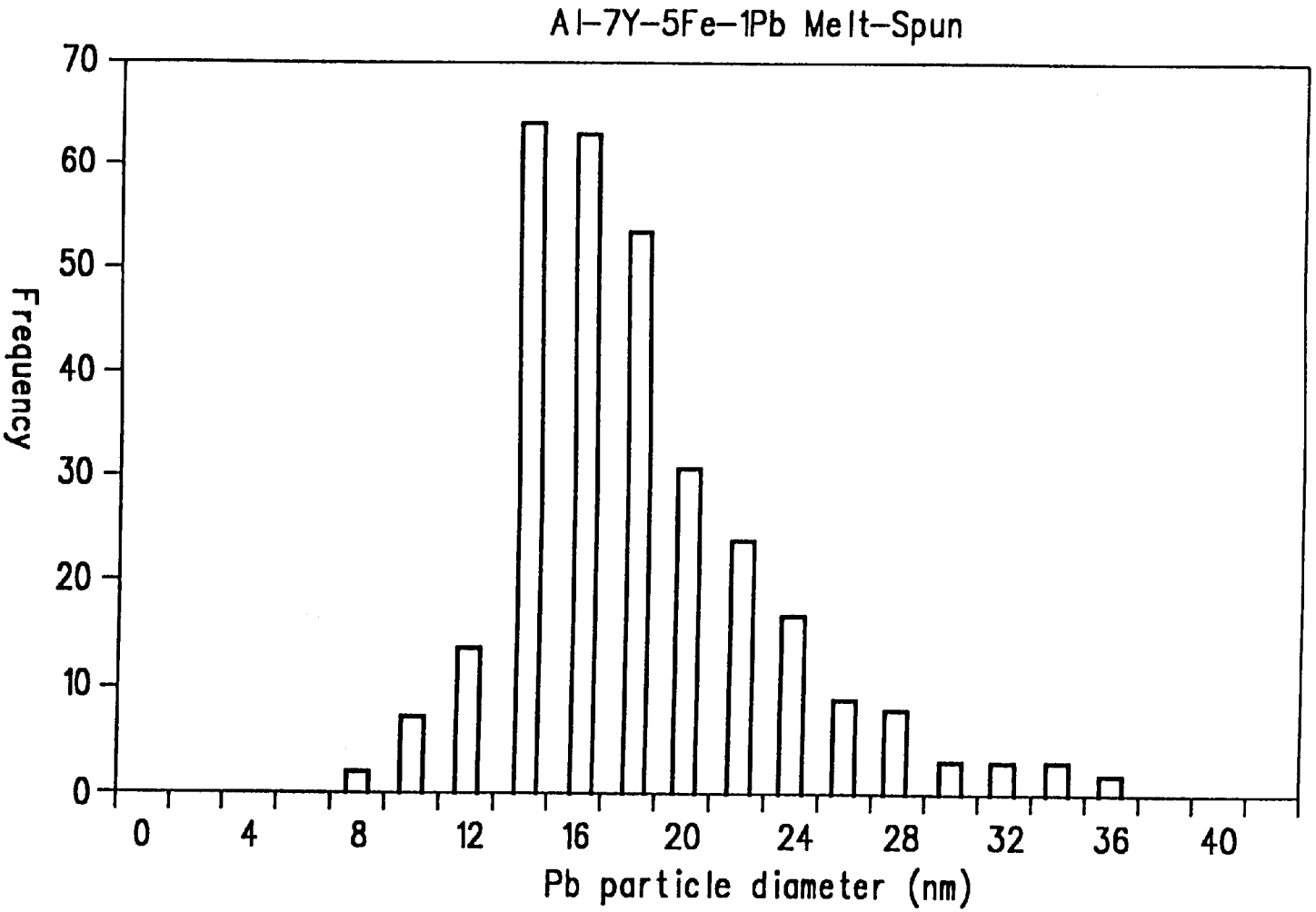
FIG. 3 illustrates a histogram of lead particle diameter distribution in the sample depicted in FIG. 1.

FIG. 2 shows a transmission electron micrograph of the cycled ribbon. It can be appreciated that there is an aluminum nanocrystal next to each particle of lead. The one to one correspondence between Pb particles and Al nanocrystals indicates the reliability of the invention. FIG. 3 shows a histogram of lead particle diameter distribution in the as-solidified ribbon. It can be appreciated that the particle size distribution is biased toward smaller particles.

Figure 4:
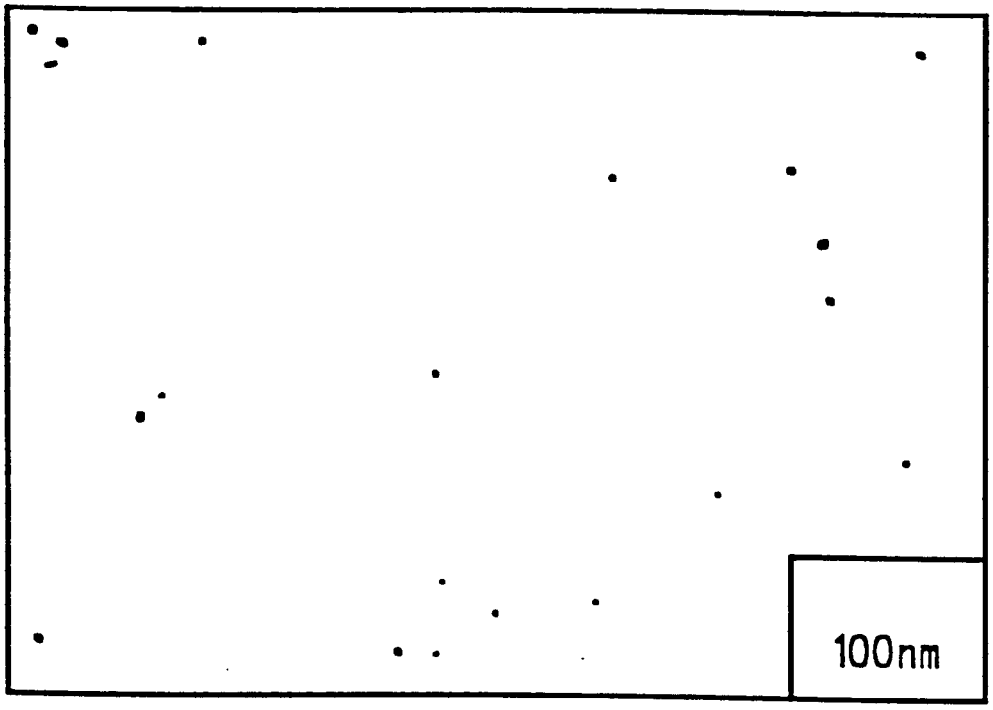
FIG. 4 illustrates a transmission electron micrograph of a sample of an Al—7Y—5Fe alloy that has been melt spun and subsequently annealed at 275° C. for 10 minutes, representing an embodiment of the present invention.
Figure 5:
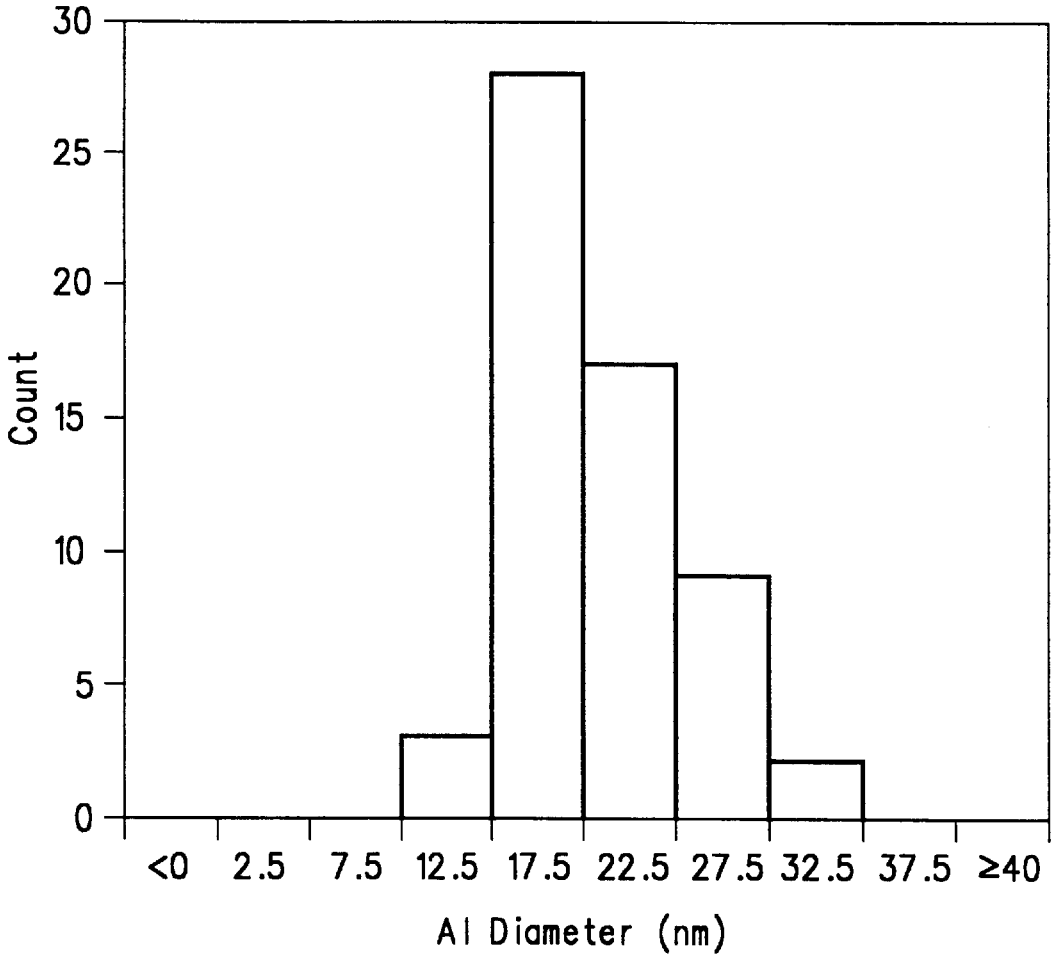
FIG. 5 illustrates a histogram of aluminum nanocrystal diameter distribution in the sample depicted in FIG. 4.

For comparison, another amorphous ribbon was solidified from a batch of 87 at. % aluminum, 7 at. % yttrium, and 5 at. % iron (Al—7Y—5Fe) by free-jet melt spinning. No lead was added to this comparative sample. FIG. 4 shows a transmission electron micrograph of the comparative sample after annealing at 275 ° C. for 10 minutes. FIG. 5 illustrates a histogram of aluminum particle diameter distribution in the comparative sample.

Theory

1. Outline of Theory Section

During primarily crystallization of multicomponent amorphous alloys a high density of nanocrystals can develop at levels up to approximately $10^{23}$ $m^{-3}$ and volume fractions of greater than approximately 0.30. For Al-based amorphous alloys at high aluminum nanocrystal densities, diffusion field impingement develops quickly above the glass transition and provides for a kinetic stabilization. A kinetics analysis (described below) has been developed to account for nanocrystal growth with diffusion field impingement and unequal component diffisivities. The kinetics analysis together with a thermodynamic model of the fcc-liquid phase equilibria for Al—Y—Fe is applied below to model differential scanning calorimetry (DSC) exotherms corresponding to primary face centered cubic (fcc) nanocrystal formation. From the kinetics analysis an estimate of the diffusion coefficient of yttrium in the Al-based liquid is obtained above the glass transition as $1.4\times10^{-17}$ $m^2$/s. New alloying strategies are discussed below based upon the implications of the kinetics analysis.

2. Introduction

Many studies of rapidly quenched amorphous alloys focus on easy glass forming ability or the crystallization onset as a measure of kinetic stability. In fact, the initial annealing response has been used to distinguish between microcrystalline and amorphous structures in terms of a continuous grain growth or a sharp onset for a nucleation and growth. With primary crystallization reactions, recent studies have indicated the critical role of transient effects and have provided valuable information on diffusion in the amorphous matrix [1]. Of special importance is the recent discovery of Al-rich glasses containing=85 at. % Al and a combination of transition and rare earth element additions [2–4]. These materials yield microstructures of a high density of Al nanocrystals ($>10^{20}$ $m^{-3}$) in an amorphous matrix with nanocrystal volume fractions approaching 30% that offer remarkably high strength.

In terms of the usual criteria, the Al-base glasses do not offer a high kinetic stability since they require a high cooling rate for synthesis and have not been produced in bulk samples. This characteristic is related to the high density of "quenched-in" nuclei that can lead to the development of Al nanocrystals. The development of a rapidly solidified glass Al-base is controlled by growth kinetic limitations. Indeed, similar reactions develop in binary Al—Sm alloys [5] suggesting that the transition metal does not play a critical role in primary crystallization, but may facilitate a broader range of easy glass formation conditions. At the same time, the continued development of high strength Al-base nanocrystalline materials has involved the incorporation of further multicomponent alloying of noble metals [6] and transition metals [7] to promote an increased nanocrystal density and a widening of the glass formation composition range.

While bulk glass formation has not been achieved as yet, the Al-base glasses do offer a high kinetic stability as measured by the primary crystallization exotherm onset [8], $T_c$, where $T_c/T_L\approx0.44$, which is again related to growth kinetic limitations. However, it has been shown that Al nanocrystals are growing slowly at temperatures below the calorimetrically determined crystallization onset [9]. An analysis of the kinetics showed that the heat evolution rate below the onset is too small for detection by usual differential scanning calorimetry (DSC) methods. On further heating to near the peak onset, the glass transition is reached. The corresponding increase in the nucleation and growth rates yields a detectable DSC signal. Diffusion field impingement was determined to be the major factor limiting nanocrystal growth. The following theoretical discussion expands upon the analysis of the heat evolution rate and particle growth rate including diffusion field impingement and multicomponent diffusion effects. While numerical methods such as that given by Kampmann et al. [10] can provide a detailed description of all stages of particle development from nucleation to coarsening, the following analytical approach is effective in describing the major factors involved in nanocrystal development. Moreover, some effects considered in the following analytical approach such as multicomponent diffusion have not yet been treated systematically with numerical methods. The following analysis is applied to primary crystallization of Al-based glasses to demonstrate the kinetic model, but it is relevant to other multicomponent metallic glasses that exhibit primary crystallization as the initial devitrification reaction.

3. Experimental Procedure

As representative systems to examine primary crystallization, Al—Y—Fe and Al—Sm alloys were selected, specifically the compositions Al—7 at. % Y—5 at. % and Fe and Al—8 at. % Sm. Alloys were produced by arc-melting high purity constituents in the desired proportions with repeated remelting to insure homogeneity. Melt spun ribbon was produced by using single roller technique with a peripheral wheel velocity of 24 meters/second in all runs; the ribbon was approximately 20 microns thick and 3–4 mm wide. Thermal analysis was performed using a Perkin Elmer DSC-7 system. X-ray diffraction (XRD) traces were obtained using standard reflection mode with a Cu Ka source. Transmission electron microscopy (TEM) was conducted on a JEOL 200CX instrument at 120 kV using standard sample thinning procedures for preparing samples from the alloy ribbons. The Al nanocrystal size measurements were made directly from the TEM negatives using a magnifying lens with a graduated reticle (±0.1 mm). Three measurements were taken of each nanocrystal.

4. Experimental Results

Figure 6A:
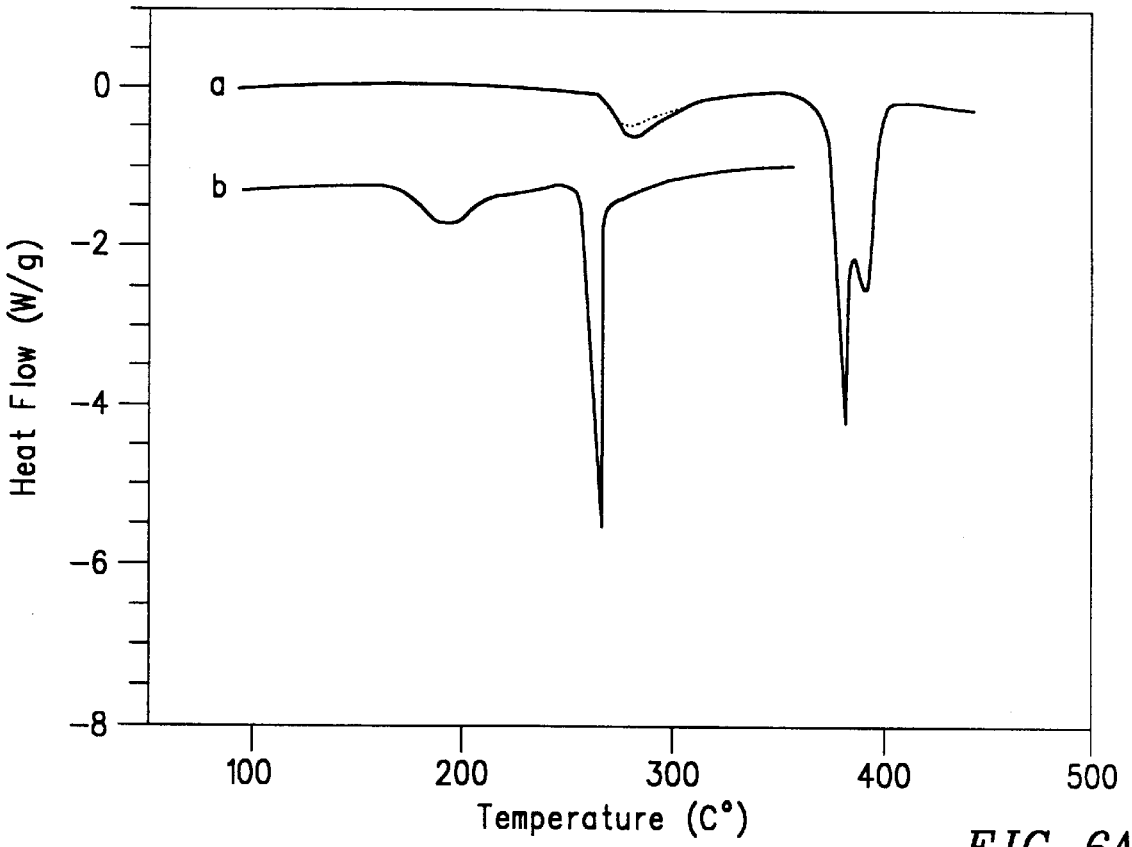
FIG. 6A illustrates a differential scanning calorimetry trace of a sample of an Al—7Y—5Fe alloy, representing an embodiment of the present invention.
Figure 6B:
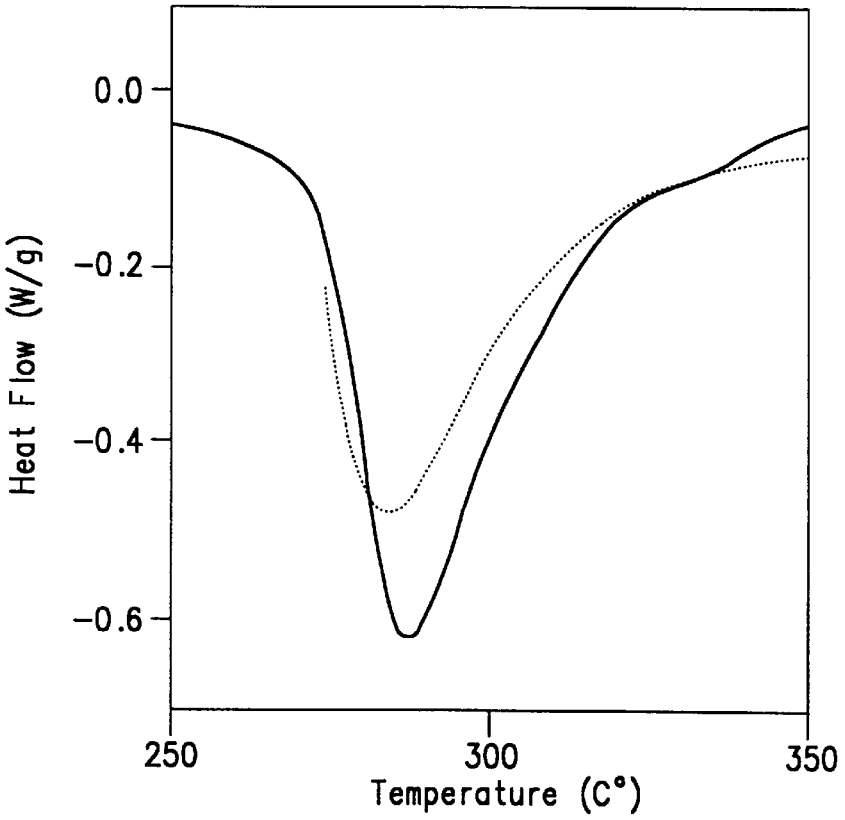
FIG. 6B illustrates a differential scanning calorimetry trace of a sample of an Al—8Sm alloy, representing an embodiment of the present invention.

A DSC heating trace of melt-spun Al—7Y—5Fe for the entire course of crystallization is shown in FIG. 6A. The first observable crystallization reaction has an onset at about 276° C.; the peak is distinctly asymmetric with a tail at high temperatures. FIG. 6(*a*) shows a DSC continuous heating trace at 40° C./min of Al—7Y—SFe showing primary crystallization reaction at 276° C. as well as crystallization reactions at higher temperatures (mass 8.36 mg). The DSC heating trace of melt-spun Al—8 Sm shown in FIG. 6B contains the same characteristic peaks. FIG. 6(*b*) shows a DSC continuous heating trace at 40° C./min of Al—8 Sm (mass 4.63) showing similar behavior.

Figure 7A:
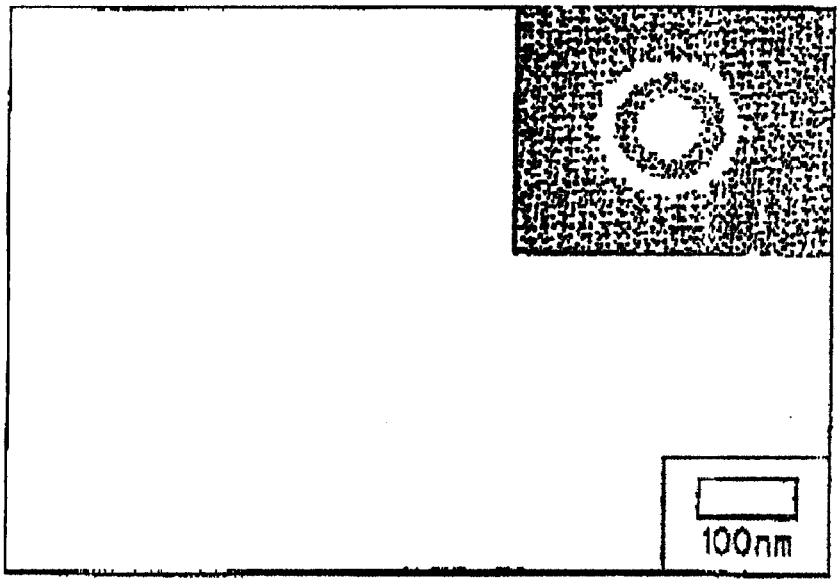
FIG. 7A illustrates a transmission electron micrograph of a sample of an Al—7Y—5Fe alloy, representing an embodiment of the present invention.
Figure 7B:
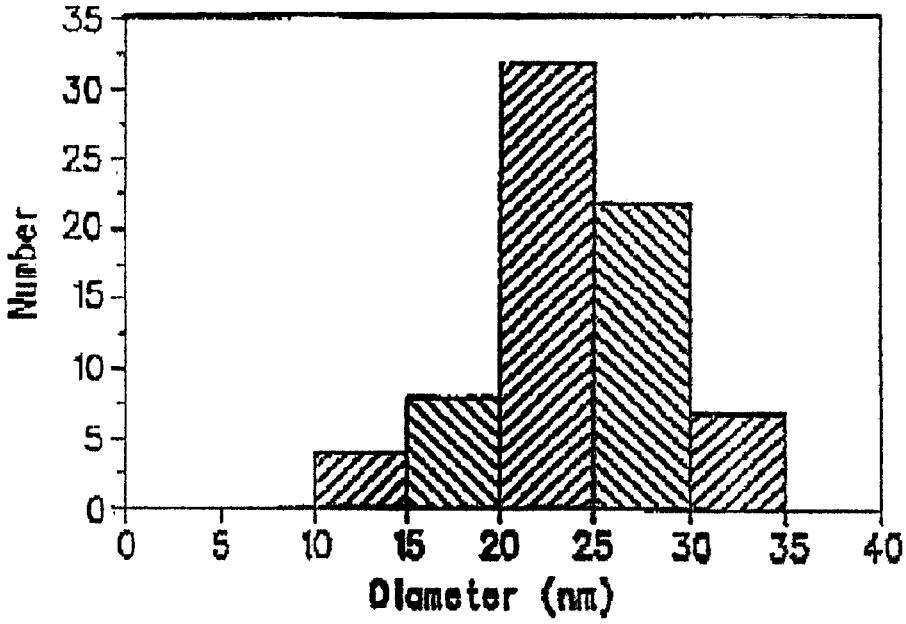
FIG. 7B illustrates a histogram of aluminum nanocrystal diameter distribution in the sample depicted in FIG. 7A.

XRD and TEM analysis indicates that the as-solidified melt-spun ribbon appears amorphous [5,11]. Moreover, heating beyond the first observable peak in Al-rich glass forming alloys results in primary crystallization of essentially pure Al [5,11]. TEM analysis of a sample (isothermal) held at 245° C. for 10 minutes (FIG. 7A) indicates development of approximately $4\times10^{21}$ $m^{-3}$ nearly spherical Al nanocrystals of 22 nm average diameter. FIG. 7(*a*) shows TEM bright-field micrograph of Al—7Y—5Fe sample held at 245° C. for 10 minutes. Some particles with unfavorable diffraction contrast may be difficult to discern in the print. FIG. 7(*b*) shows a histogram of aluminum nanocrystal diameter. The size distribution after this treatment was narrow, with a standard deviation of 4 nm (FIG. 7B). Based upon previous work [9], TEM analysis of the sample held isothermally at 245° C. for 100 minutes indicated that the nanocrystals grew further and developed a non-spherical shape, but the number density was still approximately $10^{21}$ $m^{-3}$. However, for samples isothermally held above 270° C. for 10 minutes, the nanocrystals developed into a highly dense dispersion (e.g., $1.4\times10^{22}$ $m^{-3}$ for a sample held at 275° C. for 10 minutes).

5. Discussion

The events that contribute to the development of the primary crystallization peak in DSC may be identified. In the initial state, the sample may contain quenched-in nuclei, or nucleation at a potent heterogeneous site may saturate at a respectively high density with heating. The measured particle size distributions are consistent with a heterogeneous nucleation mechanism (with transient effects) based upon a comparison to distributions generated by simulation [1]. The actual identity of the active nucleation site was not determined, but it is clear that internal nucleant concentrations far in excess of the levels usually observed in metallic melts (i.e., approximately $10^{13}$ $m^{-3}$ [12]) are present to provide for the high Al nanocrystal particle density. The nucleant sites may be related to specific structural features associated with Al-transition metal-rare earth alloys. [13]

The heat evolution due to the growth of the initial distribution of nanocrystals is too small to be detectable by DSC due to the relative low particle density and sluggish diffusion. The increase in observed particle density in the Al—Y—Fe alloys from approximately $10^{20}$–$10^{21}$ $m^{-3}$ for lower temperature treatments, and to greater than approximately $10^{22}$ $m^{-3}$ near 270° C., corresponds to the glass transition onset. Upon further heating to near the glass transition, $T_g$ (which is approximately 265° C.), the corresponding increase in diffusivity yields additional nucleation and a substantial increase in the initial particle growth rate. These effects result in a clear exotherm onset that reaches a peak value when diffusion field impingement develops between neighboring primary nanocrystals. The decaying signal for temperatures above the peak and the asymmetric character of the DSC exotherm peak arise from the influence of impingement and reduced particle growth.

While the increase in $N_v$ upon reaching glass transition may seem relatively small, many of the available nucleation sites have already been expended at the lower temperatures. Moreover, each nanocrystal growing into the amorphous matrix rejects yttrium and iron and reduces the driving force for aluminum formation; hence a "nucleation exclusion zone" forms around each nanocrystal and significantly decreases the nucleation rate in this region from what it would have been without the change in composition. Therefore, the observed increase corresponds to a significant change in behavior, as evidenced by the exothermic peak onset in the continuous heating trace.

6. Thermodynamic Model

Figure 8:
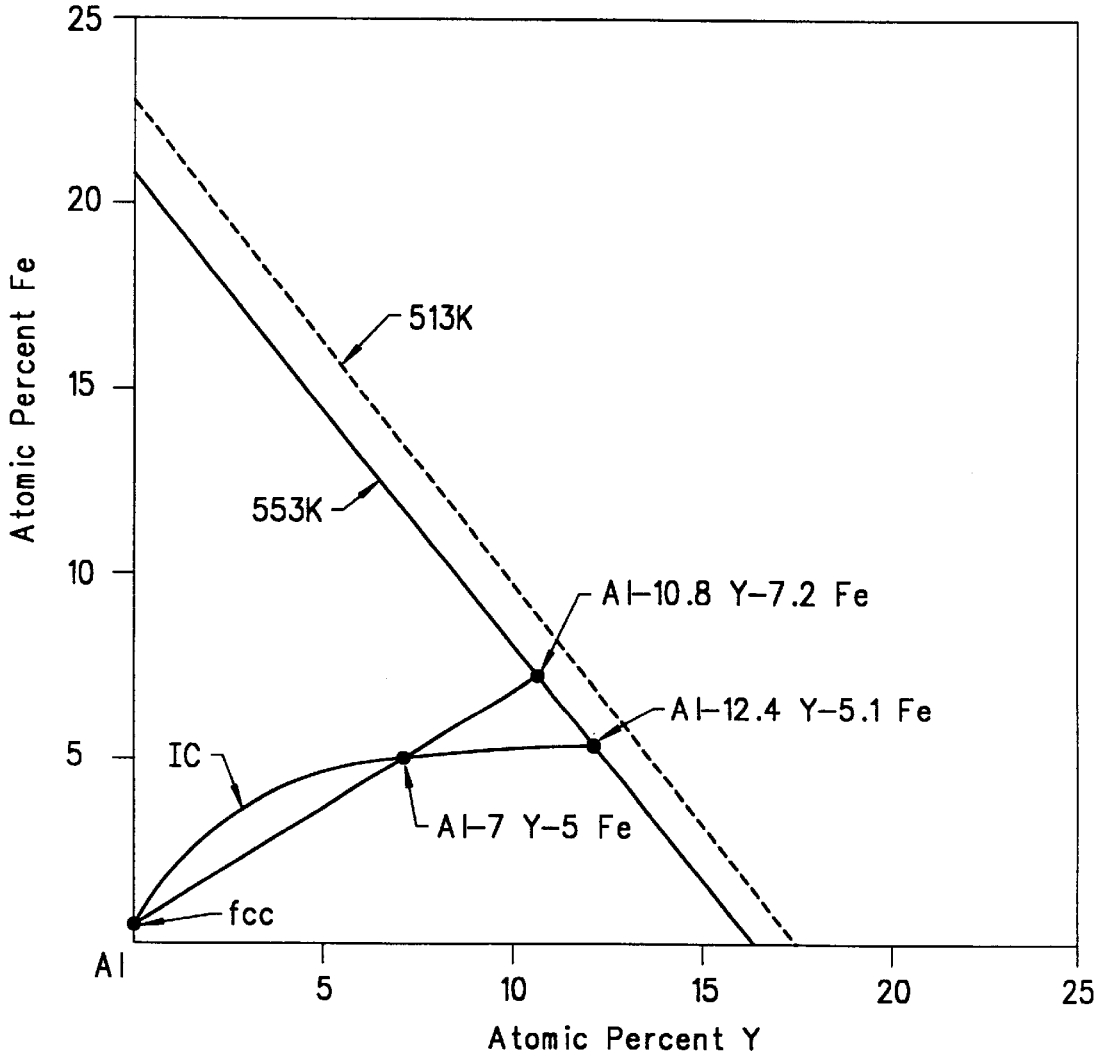
FIG. 8 illustrates a calculated metastable phase diagram at 553° K. for a sample of an Al—Y—Fe alloy, representing an embodiment of the present invention.

The details of the thermodynamic model are described in Appendix A. The calculated, metastable fcc-liquid equilibria at 553° K. are given in FIG. 8. FIG. 8 shows a calculated metastable phase diagram (553° K.) of Al—Y—Fe showing fcc-L equilibria. The dashed line shows the L boundary at 513° K. The tie line through Al—7Y—5Fe is shown and the interface contour (IC) for the Coates model is also included. The solubility of yttrium and iron in aluminum at the equilibrium eutectic temperatures of each binary system is on the order of less than approximately 0.05 and less than approximately 0.03 at. %, respectively. The alloy composition of interest (Al—7Y—5Fe) is on the tie line joining the fcc phase of composition Al—0.01Y—0.6Fe and the liquid phase of composition Al—10.8Y—7.2Fe. The bulk composition at 553° K. corresponds to volume fractions of approximately 0.345 for the fcc phase and approximately 0.655 for the liquid. The dashed line in FIG. 8 represents the liquidus (or glass) phase boundary at 513° K., illustrating that the phase boundary changes little over the temperature range of interest.

7. Modeling of Nanocrystal Growth

The kinetics of diffusion-controlled precipitate growth follows the functional relation $R\sqrt{Dt}$ (i.e., parabolic growth) in the early stages of growth prior to diffusion field impingement of adjacent particles. At long times, the growth rate, dR/dt, will approach zero at the completion of the reaction. Usually, reactions are not polymorphic and growth requires a change in composition. Under these circumstances, the tie line gives the final volume fraction transformed, which will be less than unity. The Johnson-Mehl-Avrami-Kolmogorov (JMAK) equation [14–16] provides a reasonable approximation for precipitate growth in the early states of non-polymorphic reactions [17,18], but this type of law does not treat diffusion field impingement [17].

The following analysis of the heat evolution rate for the higher temperature traces is based on the work of Ham [17], which considers spherical precipitate growth including diffusion-field impingement The model considers a cubic array of identical particles growing under diffusion control with a composition-independent diffusivity, and treats the composition profile in the matrix as an average quantity. The Ham model was developed for particle sizes much smaller than the inter-particle spacing (i.e., low supersaturation conditions). In this study, the average particle size is about one-half that of the average spacing at the maximum particle density after the completion of the reaction. Nevertheless, the Ham model will yield good accounting for the heat evolution rate except at the final states of the reaction.

The Ham model is briefly summarized immediately below with appropriate nomenclature changes for this analysis. For a precipitate size R(t) and spacing $2R_s$, Ham gives the growth rate as $$\frac{dR(t)}{dt} = \left[\frac{C_m - \overline{C}(t)}{C_p - C_m}\right]\frac{D}{R(t)} \tag{1}$$

where D is the matrix diffusivity, $\overline{C}$ is the average solute content in the matrix, and $C_p$ and $C_m$ are the precipitate and matrix compositions at the interface, respectively. Conservation of solute requires that $$\frac{4\pi}{3}(C_p - C_m)R^3(t) = \frac{4\pi}{3}R_S^3[C_0 - \overline{C}(t)] \tag{2}$$

where $C_o$ is the initial matrix composition. Eliminating R(t) from Eqs. (1) and (2) gives $$\frac{d\overline{C}(t)}{dt} = -\frac{3D}{R_S^3}\left[\frac{C_0 - \overline{C}(t)}{C_m - C_p}\right]^{1/3}[C_m - \overline{C}(t)] \tag{3}$$

The solution of Eq. (3) for which $\overline{C}(t=0)=C_o$ and for an initial particle radius of zero is $$\frac{Dt}{R_S^2}\left[\frac{C_0 - C_m}{C_p - C_m}\right]^{1/3} = \frac{1}{6}\ln\left[\frac{(u^2+u+1)}{(u^2-2u+1)}\right] - \frac{1}{\sqrt{3}}\tan^{-1}\frac{(2u+1)}{\sqrt{3}} \tag{4}$$

where $u^3=1-\overline{C}(t)/C_o$. The analysis treats the initial particle radius as zero, since the results differ negligibly from those obtained by assuming an initial size of $r^*\approx 0.7$ nm due to the small size of the critical nucleus relative to the interparticle spacing. To model the DSC behavior, the analysis may be extended to yield the expected heat evolution rate, $\dot{Q}$, during particle growth as $$\dot{Q} \equiv \frac{dQ}{dt} = (N_v V)\cdot\Delta H_v \cdot 4\pi R^2(t)\frac{dR(t)}{dt} \tag{5}$$

in which $N_v$ is the particle density, V is the sample volume, and $\Delta H_v$ is the enthalpy change per unit volume. Equations. (4) and (2) provide the quantities (t) and R(t), respectively. Note that in the early stages of reaction prior to diffusion field impingement, the average matrix composition $\overline{C}(t\approx C_o)$. Thus, from the integration of Eq. (1), R $\sqrt{Dt}$ as expected. At long times, as the reaction nears completion, the average solute content in the matrix approaches $C_m$ and thus from Eq. (1), $dR/dt\rightarrow 0$. The growth rate decays to zero as the driving force for precipitation is eliminated at long times. Since the Ham analysis treats diffusion in a binary system, the application of the model to the ternary Al—Y—Fe system requires additional considerations that are based on the work of Coates [19,20], detailed below.

8. Interface Composition

Field ion microscopy (FIM) measurements of Al—Ni—Ce alloys [21] indicate that the rare earth element diffuses much more slowly that the transition metal. These results suggest that yttrium is the slow diffuser in the Al—Y—Fe system. The Coates model accounts for diffusion limited growth of precipitates in ternary systems with unequal component diffusion coefficients. For a ternary system ABC, where B and C are solutes in A, the simplest case is given for $D_B=D_C$. Here the tie line gives the interface compositions of the precipitate and matrix (i.e., local equilibrium). If $D_B\neq D_C$, the interface compositions depart from the tie line values. For differing component diffusivities, Coates has used the concept of an interface contour (IC), which includes all bulk alloy compositions in the two-phase field that yield a given set of precipitate and matrix compositions at the interface during growth.

For purposes of this analysis, the ratio $D_{Fe}/D_y=100$ has been used which is reasonable for the large observed differences in comparison profiles of rare earth elements and transition metal [21]. Applying the Coates model for spherical growth yields the IC shown in FIG. 8. The IC through Al—7Y—5Fe includes the matrix composition Al—12.4Y—5.1 Fe and the precipitate composition Al—0.01Y—0.4 Fe. These results indicate that the initial composition of the matrix differs by only a few percent from the tie line value and the precipitate composition is essentially the same as that given by the tie line. The IC calculated for $D_{Fe}/D_y=100$ approaches the upper bound estimate for the magnitude of the multicomponent diffusion effect; in this case the results from the Coates model indicate that the matrix composition deviates from the tie line nearly as much as for $D_{Fe}/D_y\rightarrow$ .

The IC that was calculated from the Coates analysis is only valid for the initial stages of growth before the diffusion field impingement of iron. Iron is assumed to diffuse rapidly and to adjust its composition in the matrix as the composition gradient of yttrium evolves. Thus, during growth the matrix composition will move along the phase boundary to compositions higher in iron and lower in yttrium and establish new IC's. The process will continue until the reaction reaches completion. In general, a complete description of the kinetics requires that the trajectory of the IC's be modeled. But due to the restricted range of matrix compositions at the interface during the evolution of the IC's in the current case, the primary effect is due to the diffusion coefficient and the number and density of nanocrystals. Hence, a constant interface composition given by the tie line has been used in this analysis.

The disparity in solute diffusivities produces different kinetic regimes that depend on the bulk alloy composition. The Coates model indicates that along the section of the IC that is essentially constant in iron content, which includes the alloy composition of interest (Al—7Y—5Fe), the slow diffusing element yttrium) limits the kinetics. Along the part of the IC that is essentially constant in yttrium which is restricted to near pure Al for the current conditions, the fast diffusing element (iron) governs the kinetics. Hence the delineation of IC's in a multicomponent alloy system is essential to gauging the kinetic response during growth.

In some alloy systems, the matrix phase boundary can differ to a greater extent from the precipitate composition than in Al—Y—Fe, and the multicomponent diffusion effect will be proportionately larger. That is, the composition given by Coates model and that given by the tie line will differ to a larger extent As is discussed later, the IC concept may be exploited for alloy design.

The small (nm) size of the aluminum phase requires an assessment of the Gibbs-Thomson effect. The calculations are based on solid-liquid interfacial energy that was estimated at 170 mJ/m$^2$ from the maximum undercooling of the alloy [22]. Since the solubility of Y and Fe in the fcc (Al) phase is so small (<0.01% Y and <0.6% Fe for the tie line of interest), the magnitude of the Gibbs-Thomson effect is also small and has been neglected in this analysis. For example, even for a particular diameter of 4 nm, the Gibbs-Thomson effect gives an estimated increase in solubility of 45% over the bulk value. But this increase still only yields negligible solubility of yttrium and <1 at. % Fe. For nanocrystals that have higher solubility levels, the Gibbs-Thomson effect would need to be included in a growth kinetics analysis.

9. Application of the Ham Model

The parameters needed for the Ham model include the Al nanocrystal particle density, which is obtained from TEM analysis; the enthalpy of crystallization and the interface compositions, which are obtained from the thermodynamic model; and the diffusivity, which is a free parameter in the analysis. The diffusivity used to model the DSC exotherm corresponds to the volume diffusion coefficient of yttrium in the liquid phase near $T_g$ rather than the amorphous phase.

The growth kinetics analysis is applied to both the isothermal and continuous heating scans due to the inherent limitations of each type of trace. The isothermal traces have substantial instrumental transients at early times (<20–30 seconds) that are convoluted with the actual data. This transient is large even after subtraction of the trace with a pure aluminum standard [9]. For the continuous heating trace, two of the assumptions of the Ham analysis must be relaxed: constant composition at the interface and constant diffusivity.

The thermodynamic model shows that the composition of the matrix at the interface changes slowly over the temperature rate of interest (see FIG. 8). The assumption of constant diffusivity requires additional discussion. Recent work [23] has indicated that the Stokes-Einstein relation between viscosity and diffusivity breaks down near the glass transition, since the defects associated with momentum transport differ from the defects associated with solute transport. Indeed, Wagner and Spaepen show that while the viscosity changes very rapidly near $T_g$, the variation in diffusivity with temperature is modest (for Pd—6 Cu—16.5 Si, D changes by less than a factor of 3 over a range of 15° K. near $T_g$). Analysis of Pd—Ni—P [24] and Pd/Si/Fe multilayer [25] data also support the divergence of viscosity and diffusivity behavior near $T_g$.

Figure 9:
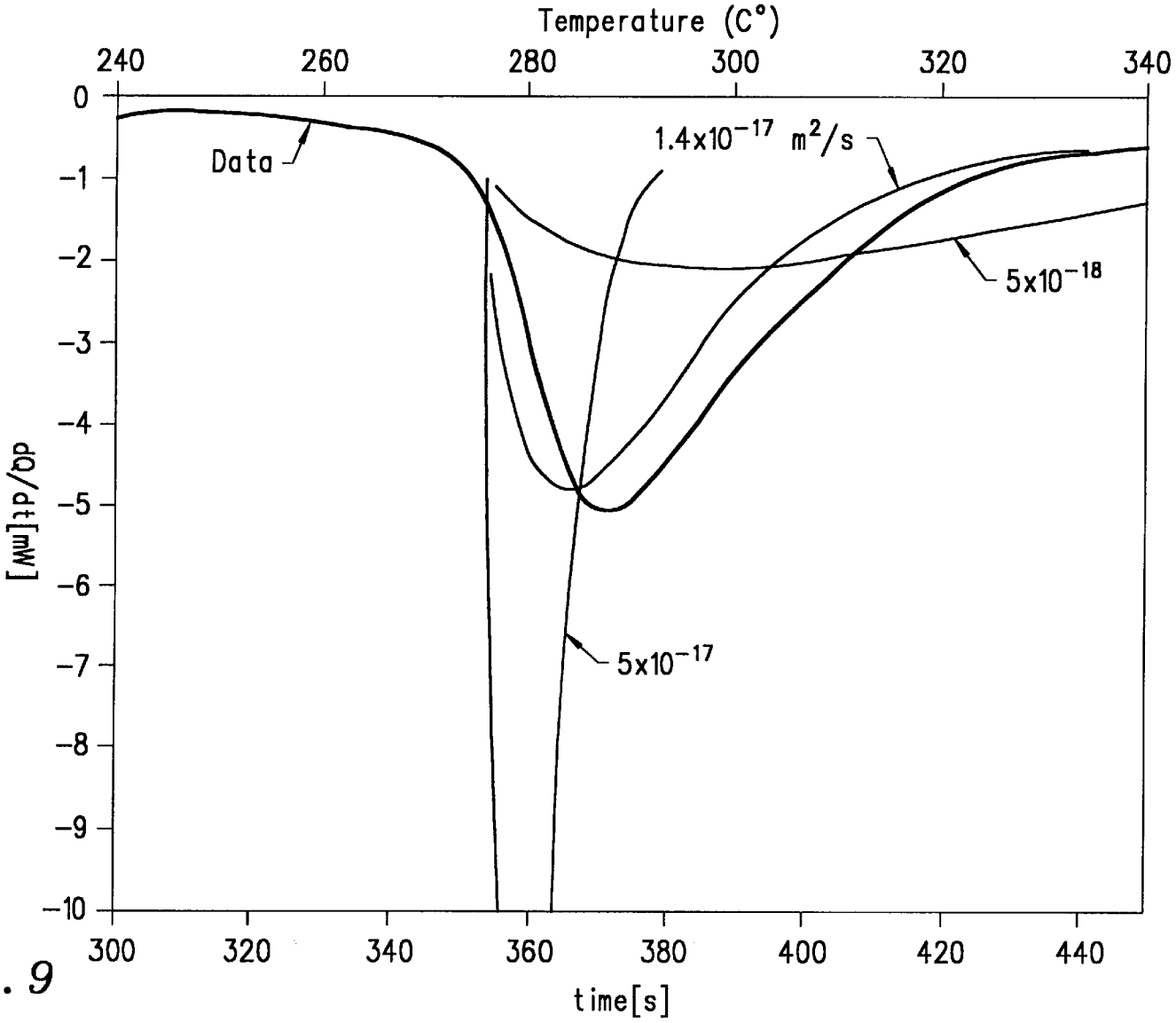
FIG. 9 illustrates a model of a continuous heating trace peak from the Al—7Y—5Fe sample used to obtain the data depicted in FIG. 6A–6B.
Figure 10:
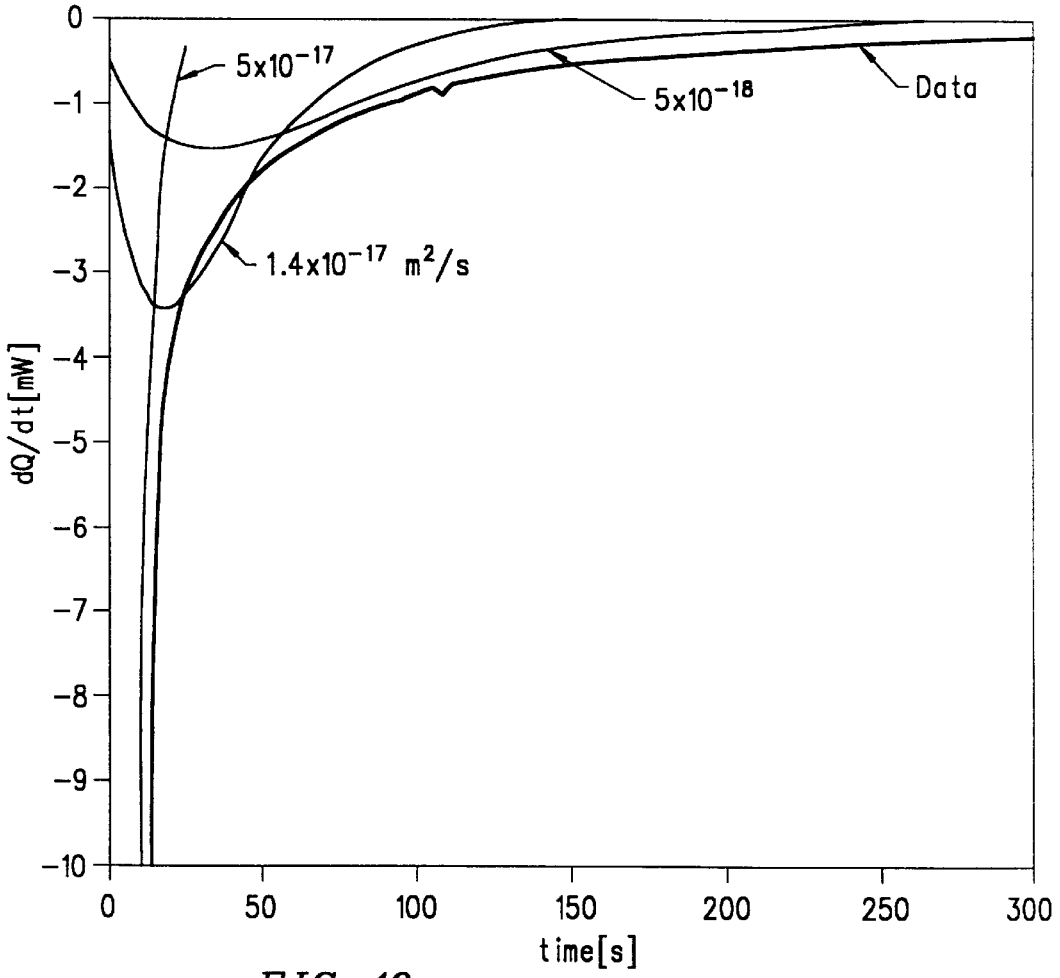
FIG. 10 illustrates an isothermal differential scanning calorimetry trace at 280° C. after subtraction with an Al standard, representing an embodiment of the present invention.

The Ham analysis was applied to the continuous heating trace with the starting time (i.e., peak onset) for the reaction determined to be 355 seconds (time zero refers to the start of the heating trace at room temperature), $N_v$=1.8×10$^{22}$ m$^{-3}$ and $\Delta H_v$=−2.84×10$^8$ J/m$^3$. FIG. 9 shows the expected heat evolution rates for the continuous heating trace for three different $D_Y$ values; the best agreement with the data is for $D_y$≈1.4×10$^{-17}$ m$^2$/s. FIG. 9 shows a modeling of a continuous heating trace peak of Al—7Y—5Fe from FIG. 6 shown as a function of time. The peak has been fitted with three values for the yttrium diffusion coefficient: 5×1$^{-18}$, 1.4×10$^{-17}$, and 5×10$^{-17}$ m$^2$/second. A fit to the 280° C. isothermal trace with $N_v$=1.8×10$^{22}$ m$^{-3}$ also showed reasonable agreement with $D_y$≈1.4×10$^{-17}$ m$^2$/s (FIG. 10). FIG. 10 shows an isothermal DSC trace at 280° C. after subtraction with an aluminum standard. The instrumental transient signal dominates at short times. The isothermal trace has been fitted with three values for the yttrium diffusion coefficient: 5×10$^{-18}$, 1.4×10$^{-17}$, and 5×10$^{-17}$ m$^2$/second. Note that the predicted heat evolution curves appear to be shifted to longer times than the data. This shift may be due to partial reaction before the time zero of the DSC trace. In each calculation, all of the particles were assumed to nucleate at the reaction starting point (i.e., the peak onset for the continuous heating trace and the DSC time zero for the isothermal trace).

The diffusion coefficient deduced from the application of the Ham model to the isothermal trace at 280° C. is consistent with that deduced from the continuous heating trace. The agreement of the Ham model to the data over the entire temperature range of the peak provides additional support for the conclusion that the diffusion coefficient changes little during the first crystallization peak. If the diffusivity changed rapidly over the temperature range of the peak, the analysis would agree with only part of the data.

The calculation results shown in FIGS. 9 and 10 indicate that as the assumed diffusion coefficient increases, the reaction peak becomes sharper with a larger amplitude, while the total peak area remains constant The reaction also reaches completion more rapidly. Similar results are obtained if the assumed particle density increases (at a constant supersaturation level). The increase in reaction kinetics with increasing particle density arises due to the nature of diffusion-limited growth. If the particle density is large, the diffusion distances are smaller and the reaction reaches completion faster than for smaller particle densities. The accuracy of the diffusivity obtained from the Ham model is limited primarily by the accuracy of the measured particle density, $N_v$. Examination of equation (4) indicates that D and $N_v$ are related through the parameter, Rs, where $$N_v\ 1/R_s^3 \tag{6}$$

Thus, a factor of 3 error in $N_v$ gives a factor of approximately 2 error in D.

Figure 11:
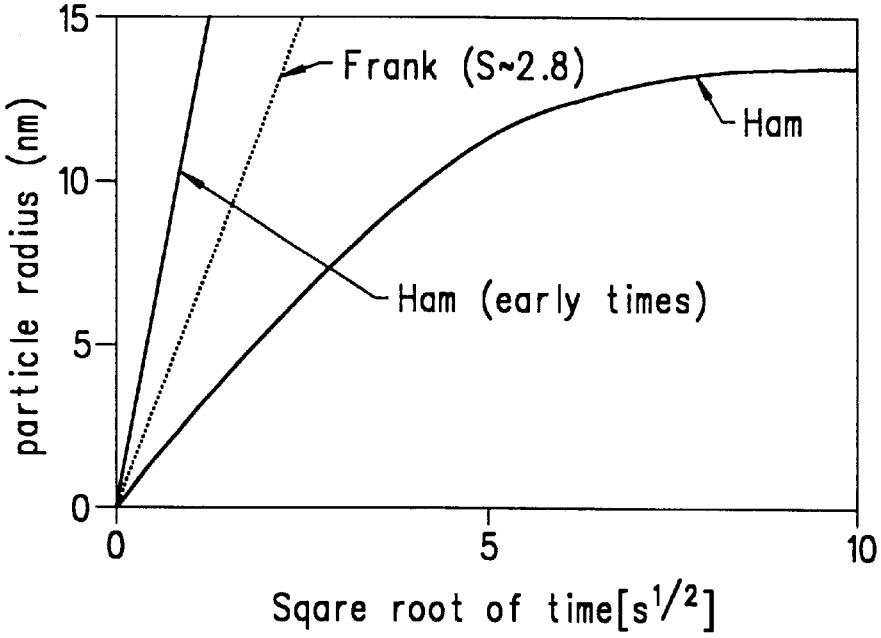
FIG. 11 illustrates calculated particle radius as a function of the square root of reaction time given by the Ham model, representing an embodiment of the present invention.

The Ham analysis predicts a rapid deviation from parabolic growth behavior given the high observed particle density and the estimated diffusion coefficient (FIG. 11). FIG. 11 shows calculated particle radius as a function of the square root of reaction time given by the Ham model (solid line) for $N_v$=1.8×10$^{22}$ m$^{-3}$ and $D_y$=1.4×10$^{-17}$ m$^2$/second. Also shown are the particle radius given by R=S√Dt with S≈2.8 (Ham model at early times) and S≈1.5 (Frank model). Time zero of this plot corresponds to the peak onset (t=355 seconds in FIG. 9); The predicted particle radius becomes less than that given by Expression (7) after only a few seconds for temperatures above the glass transition, highlighting the need to consider diffusion-field impingement in a growth kinetics analysis involving high particle densities.

$$R=S\sqrt{Dt} \tag{7}$$

The analysis has been based on the assumption that the diffusion coefficient does not change with composition. Some reports have suggested that the inhibited growth of the nanocrystals is due to solute buildup [2]. However, the substantial additional growth of the nanocrystals at 245° C. for annealing times longer than 10 minutes [9] indicates that the diffusivity is not a strong function of composition in this system. Indeed, further analysis indicates that a single diffusion coefficient describes growth at 245° C. until diffusion-field impingement occurs [22]. While composition gradient effects may indeed be important, especially for intermetallic formation [2], this analysis shows that with typical D values for amorphous alloys [26], diffusion field impingement alone can account for the observed primary crystallization behavior. Thus, the key feature in the kinetic stabilization of nanocrystals developed during devitrification is a high initial nucleation density.

At the later stages of growth after diffusion field impingement, the JMAK equation may give the correct qualitative behavior with the proper exponent, but it is not a rigorous description for growth during non-polymorphic transformations. Christian [18] has noted that for parabolic growth, the exponent in the JMAK equation is n=5/2 for continuous nucleation and n=3/2 for early site saturation of nuclei. The heat evolution for n=3/2 (site saturation) has a qualitative shape similar to that predicted by the Ham analysis. Note that one of the assumptions of the Ham analysis was a preexisting array of particles, which is similar to early site saturation of heterogeneous nuclei. The Ham model improves upon the JMAK analysis to quantitatively describe growth during the entire period of growth for non-polymorphic transformations. Thus, kinetics parameters may be extracted with greater confidence from a description of growth with the Ham model as compared to a similar description with the JMAK model.

10. Composition Profile

The Ham analysis provides the growth rate for a spherical particle under the condition of diffusion-field impingement, but does not provide composition profile information for the matrix, since this composition level is treated as an average quantity. To illustrate further the importance of impingement, the diffusion fields of two adjacent particles were each calculated by assuming growth into an indefinite matrix. Frank [27] has developed the solution to the moving boundary problem in spherical coordinates. The composition, C, in the matrix ahead of the interface is given as $$C-C_o=\tfrac{1}{2}(C_m-C_p)S^3\exp(S^2/4) \tag{8}$$

where $s=r/\sqrt{Dt}$ and r is the radius of interest. The rate of particle growth with time is $R=S\sqrt{Dt}$ where $S\approx1.5$ for growth limited by the diffusion of yttrium. The value of $S\approx1.5$ given by the rigorous Frank solution agrees well with that from the Ham analysis ($S\approx2.8$).

Figure 12:
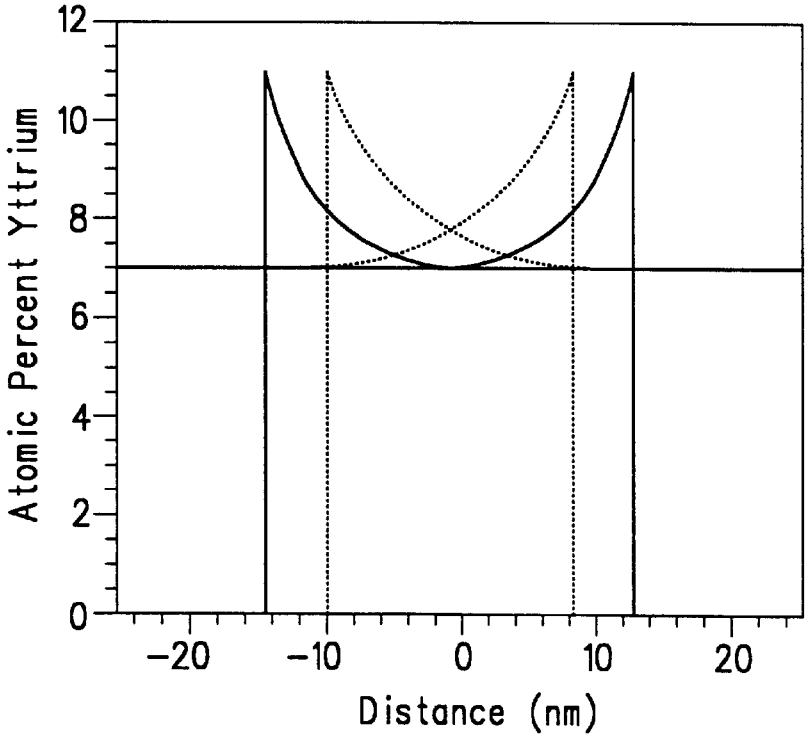
FIG. 12 illustrates calculated diffusion fields for aluminum particles that are 40 nanometers (nm) apart, representing an embodiment of the present invention.

FIG. 12 shows the composition profiles of two adjacent particles that were calculated by assuming an infinite matrix. FIG. 12 shows calculated diffusion fields for yttrium for particles 40 nm apart with midpoint between nanocrystals at zero at 4 seconds (solid lines) and 8 seconds (dashed lines) for $D^Y=1.4\times10^{-17}$ $m^2$/second. Vertical lines represent the interfaces between Al and the amorphous matrix. Note that with conditions similar to those found to fit the exotherm in FIG. 6, ($D_Y\approx1.4\times10^{-17}$ m/s and a particle spacing of 40 nm, which corresponds to $N_v\approx1.6\times10^{22}$ $m^{-3}$), diffusion field impingement begins at approximately 4 seconds and becomes significant at approximately 8 seconds.

The calculated composition gradient near the interface at 4 seconds is greater than approximately $10^6$ $m^{-1}$, which is of sufficient magnitude to affect the nucleation kinetics [2]. Gradient effects will reduce the effective nucleation rate in the matrix near the interface. Since solute levels are enriched near the interface, intermetallic phases would be the most likely phases to form. Hence in the initial stages, gradient effects tend to stabilize the Al-nanocrystal/amorphous matrix structure and inhibit the formation of additional crystalline phases.

11. Coarsening

Since this analysis considers growth of a large number of very small (nanometer scale) particles, the effect of particle coarsening on the microstructural development must be considered. Greenwood [28] has shown that particles of twice the average radius (i.e., 2) grow at the fastest rate. The observed particle distributions tended to be narrow, so coarsening effects will be much less pronounced compared to distributions that include a wide range of particle sizes. The maximum growth rate due to coarsening may be expressed as [28]

$$\left(\frac{dR}{dt}\right)_{\max}=\frac{DC_mM\sigma}{2RT\rho^2}\cdot\frac{1}{R^2} \tag{9}$$

where D is the diffusivity in the matrix, $C_m$ is the solubility in the matrix, M is the atomic weight of the diffusing species, a is the particle-matrix interfacial energy, and ρ is the density of the diffusing species. The diffusion of yttrium limits the coarsening rate. At 245° C. (i.e., below the glass transition), $D_y\approx9\times10^{-20}$ $m^2$/s [9] and ≈11 nm after 10 minutes, so the maximum growth rate due to coarsening is about 0.2 mn/hour. This rate is insignificant for the time scale of the isothermal treatments (10–100 minutes). For temperatures near 270° C. (i.e., near the glass transition), $D_y\approx1.4\times10^{-17}$ $m^2$/s and R≈15 after 10 minutes; thus the maximum coarsening rate is about 0.16 nm/min. While this latter value is significant for long holding times, the change in particle size due to coarsening is small for the annealing treatments in this study (10 minutes).

12. Alloying Strategies

Since many of the metallic glass forming systems have been discovered based upon the empirical rule of adding solutes with a large difference in atomic size [29], a disparity in the solute diffusivities may be expected. The growth kinetics of nanocrystals during primary crystallization of these glass materials will be strongly affected by unequal solute diffusivities. Therefore, alloying strategies can be developed that exploit the effect of multicomponent diffusion on the growth behavior. These strategies apply to any glass-forming material that has unequal diffusion coefficients and a region of glass stability, including the Al- and Fe-based materials.

The glass transition temperature in metallic glass-forming systems often develops a maximum within the ternary diagram [30], producing a region of glass surrounded by liquid in composition space. This tendency suggests two different strategies that can be applied with a consideration of the multicomponent of the multicomponent diffusion effect.

Figure 13:
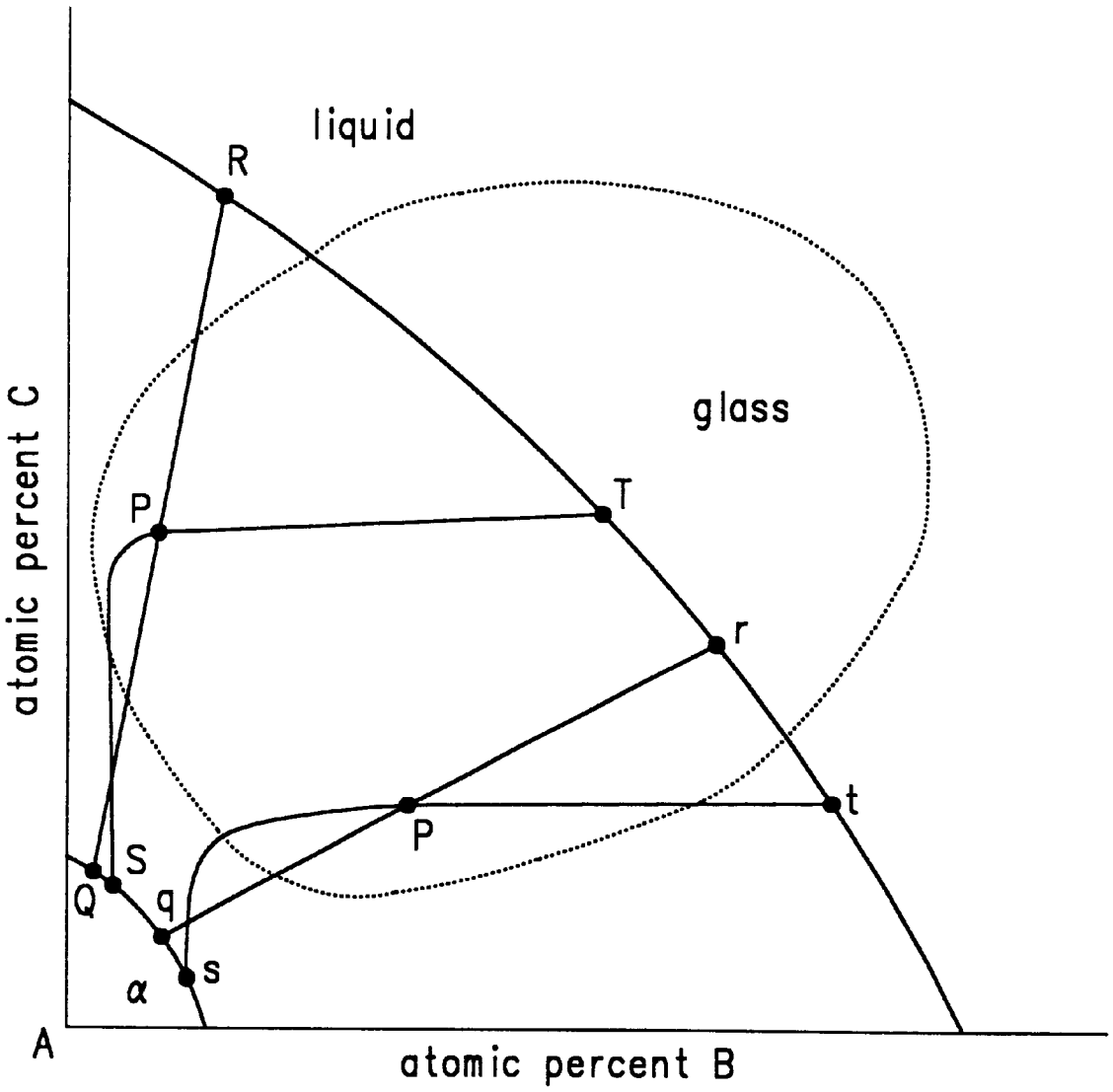
FIG. 13 illustrates a schematic isothermal ternary section illustrating alloying strategies that exploit the effects of multicomponent diffusion, representing an embodiment of the present invention.

The first strategy considers an alloy composition P (FIG. 13) in equilibrium with the solid a phase of composition Q and liquid phase of composition R. FIG. 13 shows a schematic isothermal ternary section illustrating alloying strategies that exploit the effects of multicomponent diffusion. The tie lines and interface contours for two different alloys (P and p) are shown. The dashed line delineates the glass region. The solubility of the α phase has been exaggerated for clarity. If the diffusivities of B and C were equal, growth of the α phase would yield compositions at the α-L interface given by the tie line. With $D_B<D_C$, the IC given by the curve SPT develops. Note that the interface composition T is now in the glass region rather than the liquid. Since the diffusivity of the glass is much smaller than that of the liquid, the growth rate of the α phase is substantially reduced. This phenomenon allows for higher relative amounts of component C compared to component B, while retaining the interface composition of the amorphous matrix in the glass region rather than the liquid region. Thus, growth of the primary nanocrystals is limited by diffusion in the glass rather than in the liquid, significantly decreasing the growth rate. Note, though, that due to mass conservation new IC's will develop and composition T will track along the liquids boundary in the direction of R and eventually surpass it. The capability of increasing the amount of component C while retaining good kinetic stability of the material is useful when additions of C yield improvement of desired material properties. This situation allows extended, elevated temperature capability for a nanocrystal/amorphous matrix composite material for the alloy composition P. However, if $D_B > D_C$, the matrix composition T of the IC given by SPT will lie on the liquid's boundary to the left of composition R rather than to the right as is shown in FIG. 13, and the kinetics would be based on growth into the liquid rather than the glass.

The second strategy provides for the capability of enhanced reaction rate. FIG. 13 shows the tie line qpr that describes equilibrium between a and the glass phase. With $D_B < D_C$, the system establishes the IC given by the curve spt during growth of the α phase. Thus, the IC gives the interface composition of the amorphous matrix as within the liquid phase rather than the glass phase. A fast reaction rate is useful for the rapid formation of the desired nanocrystal structure, before undesired phases (such as intermetallics) could nucleate and grow. Moreover, oxidation and other effects such as vaporization of volatile constituents are minimized with shorter heat treatment times.

13. Summary of Theory Section

A high nucleation density is clearly an important prerequisite for the development of nanocrystal dispersions during primary crystallization of metallic glass. A microstructure of $10^{21}$ $m^{-3}$ crystals of 20 nm diameter in an amorphous matrix can be readily detected by TEM, but the net heat generation is too weak for detection by the usual DSC methods. Upon approaching $T_g$, the enhancement of diffusivity promotes further nucleation and growth. However, the high nanocrystal density ($10^{22}$–$10^{23}$ $m^{-3}$) results in rapid diffusion field impingement that arrests growth. This provides a mechanism to limit nanocrystal growth and maintain the high density of nanocrystals. The analysis of Ham yields a description of diffusional growth that includes the effects of diffusion field impingement. The modeling of nanocrystal development with this approach provides a good accounting for the DSC exotherm. Since yttrium and iron diffuse at different rates, the interface compositions deviate from the tie line values. Although this effect is small in the Al—Y—Fe system, in some systems it may be substantial and must therefore be included in a growth kinetics analysis. The tendency for glass-forming materials to have disparate solute diffusivities can be exploited to develop alloying strategies. Application of the Coates model permits the identification of composition ranges that provide either rapid reaction rate or enhanced thermal stability.

14. Appendix A: Thermodynamic Model

A thermodynamic model was applied to the Al—Y—Fe system to obtain enthalpy values for modeling the DSC behavior. A calculation of the fcc-liquid phase equilibria was based on tabulated lattice stability estimates (except for fcc Y) and Redlich-Kister [31] polynomials for the excess Gibbs free energy of the fcc and liquid phases. The excess free energy polynomials were truncated to temperature-independent terms of zero order for the fcc phase in each binary system and for the liquid phase in the Fe—Y and Al—Y binary systems. Temary interaction parameters were neglected. This procedure yielded an excess free energy function of the form ${}^{xs}G^L = X_{Al}X_Y L^L_{Al,Y} + X_{Al}X_{Fe}L^L_{Al,Fe} + X_{Fe}X_Y L^L_{Fe,Y}$, where the $L_{i,j}^L$ terms are the interaction parameters and the $X_i$ terms are the mole fractions. In this analysis, $$L^L_{i,j} = {}^0L^L_{i,j} = \text{constant},$$

constant, except for the liquid phase in the Al—Fe system.

The lattice stability for yttrium in the fcc structure was based upon theoretical estimates combined with SGTE values [32] for the bcc and hcp structures. Saunders [33] has given $S_Y^{fcc} - S_Y^{bcc} \approx -3.0$ J/mole K and Guillermet [34] has given $H^{fcc}_{y\text{-}y}{}^{hcp} \approx +1000$ J/mole. These values along with SGTE lattice stability approximations for the temperature range of interest $$G_Y^{fcc} - G_Y^{hcp} \approx 1000 - 0.432T.$$

Table 1 summarizes the lattice stabilities.

Enthalpy of solution measurements at 1873 K from references [36] and [37] provided the interaction parameters $${}^0L^L_{Fe,Y} \text{ and } {}^0L^L_{Al,Y}$$

respectively. The interaction parameters for the Al—Fe binary system have been taken from the work of Murray [38] for 0–25 at. % Fe. The measured solubility of yttrium in fcc-Al at the eutectic temperature provided an estimate of $${}^0L^{fcc}_{Al,Y}$$

the measured enthalpy of solution for an Fe—50 at. % Y alloy [39] provided an estimate of $${}^0L^{fcc}_{Fe,Y}.$$

Table 2 summarizes the interaction parameters.

TABLE 1

Summary of lattice stabilities (Y lattice stabilities valid from 450–900K)

| lattice stability | value (J/mole) | reference |
|---|---|---|
| ${}^0G_Y^{hcp}$ | 0 | adapted from [32] |
| ${}^0G_Y^{bcc}$ | 4857.2-2.568 T | adapted from [32] |
| ${}^0G_Y^{fcc}$ | 1000-0.432 T | this work |
| ${}^0G_Y^{L}$ | 8113.9 + 0.288 T −2.65 × $10^{-3}T^2$ | adapted from [32] |
| ${}^0G_{Al}^{fcc}$ | 0 | [33] |
| ${}^0G_{Al}^{L}$ | 10711-11.473 T | [33] |
| ${}^0G_{Fe}^{bcc}$ | 0 | [35] |
| ${}^0G_{Fe}^{fcc}$ | 6109-3.462 F −0.7472 × $10^{-2}T^2$ +0.5125 × 10−5T3 | [35] |
| ${}^0G_{Fe}^{L}$ | 13807.2-7.6316 T | [35] |

TABLE 2

Summary of thermodynamic parameters

| parameter | value (J/mole) | reference |
|---|---|---|
| $L_{Al,Y}^{fcc}$ | −24000 | this work |
| $L_{Al,Y}^{L}$ | −140000 | [37] |
| $L_{Al,Fe}^{fcc}$ | −24000 | [38] |

TABLE 2-continued

Summary of thermodynamic parameters

| parameter | value (J/mole) | reference |
|---|---|---|
| $L_{Al,Fe}^{L}$ | $(-78000 + 18.4\ T) - 6000(1 - 2ZX_{Fe})$ | [38] |
| $L_{Fe,Y1}^{fcc}$ | −24000 | [36] |
| $L_{Fe,Y}^{L}$ | −33500 | [33] |

Figure 14:
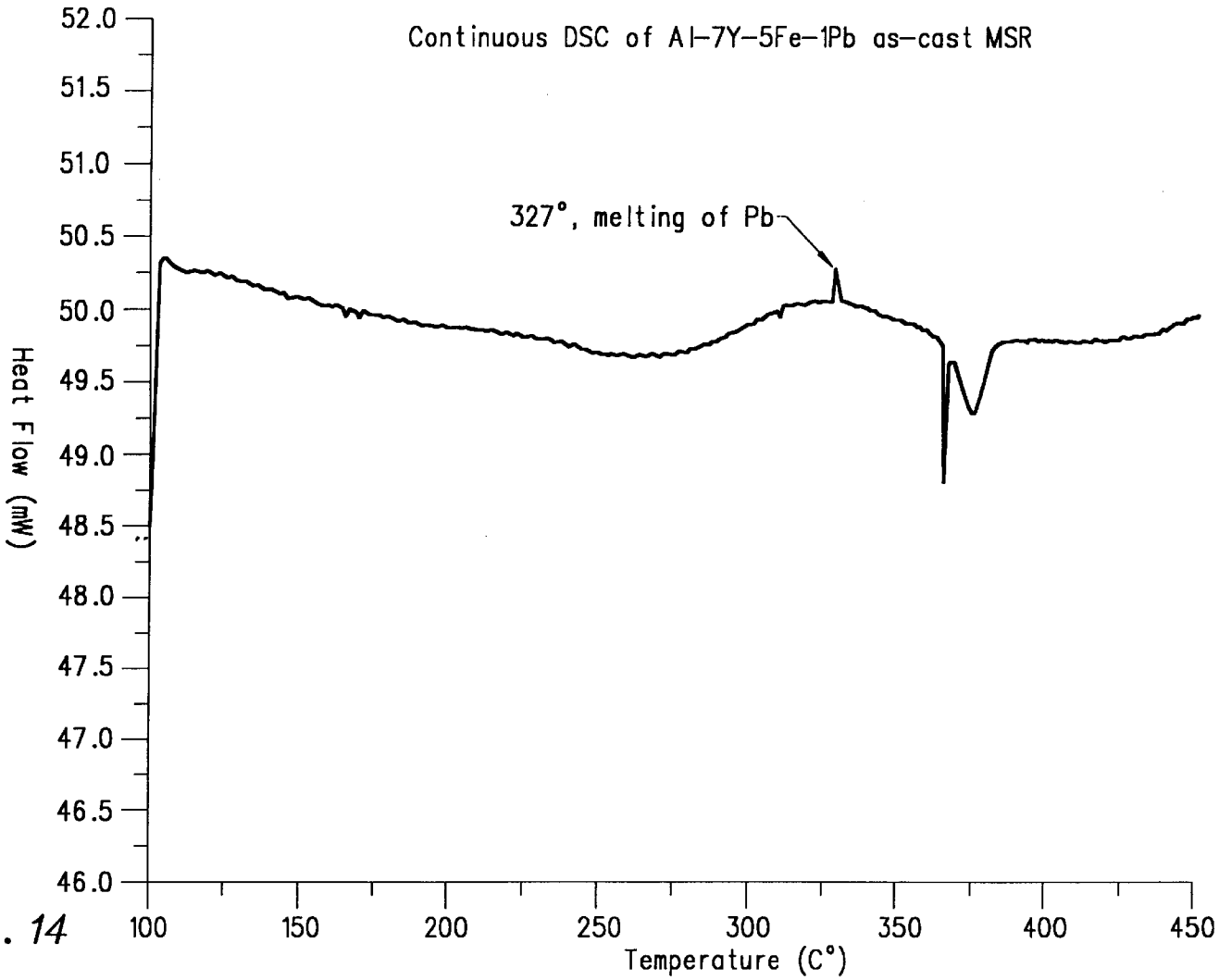
FIG. 14 illustrates a continuous differential scanning calorimetry (DSC) trace of an Al—7Y—5Fe—1Pb as-cast melt spun ribbon (MSR) sample, representing an embodiment of the present invention.

The invention includes a simple and effective method for detecting the Pb. This is attractive from the point of view of identifying "unknowns" that are in fact embodiments of the invention that include lead. Previously, it was necessary to use TEM (transmitting electron microscopy), which is tedious and time consuming, to detect the presence of Pb in embodiments of the invention such as, for example, melt spun ribbon. The Pb can be detected with thermal analysis which is a quick method. Support for this method of detection is shown in the DSC trace for an Al—7Y—5Fe—1Pb as cast melt spun ribbon that is depicted in FIG. 14. During heating at 20° C./min the trace shows the characteristic broad crystallization exotherm (around 250° C.) that is due to the development of Al nanocrystals and then a sharp endotherm at 327° C. due to the melting of Pb. This is followed at higher temperatures by two exotherms due to the development of intermetallic phases. However, sometimes, there is no observation of the Pb melting signal. This may be due to a nonuniform distribution of Pb in the sample.

Figure 15:
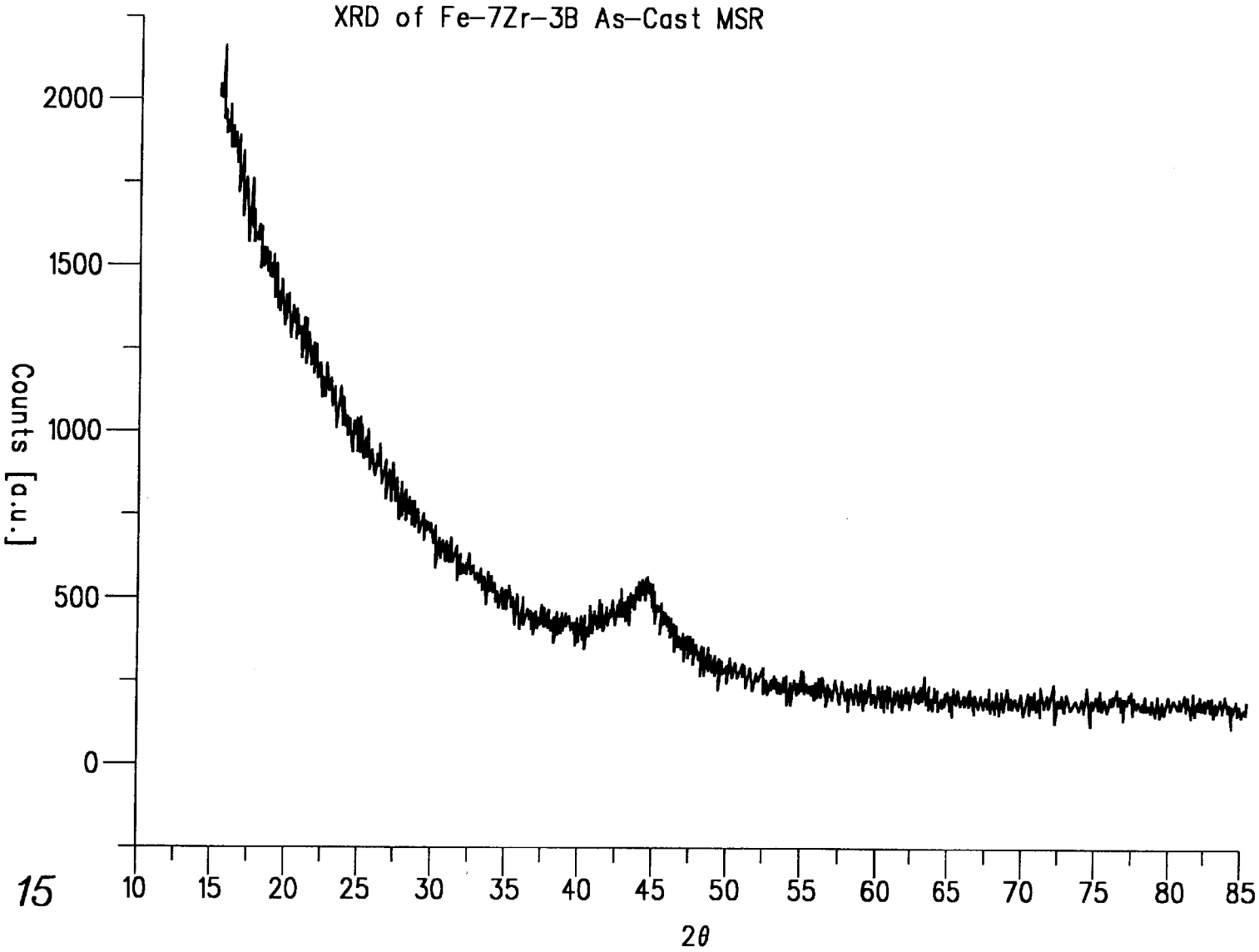
FIG. 15 illustrates an XRD pattern of an Fe—7Zr—3B as-cast MSR sample, representing an embodiment of the present invention.
Figure 16:
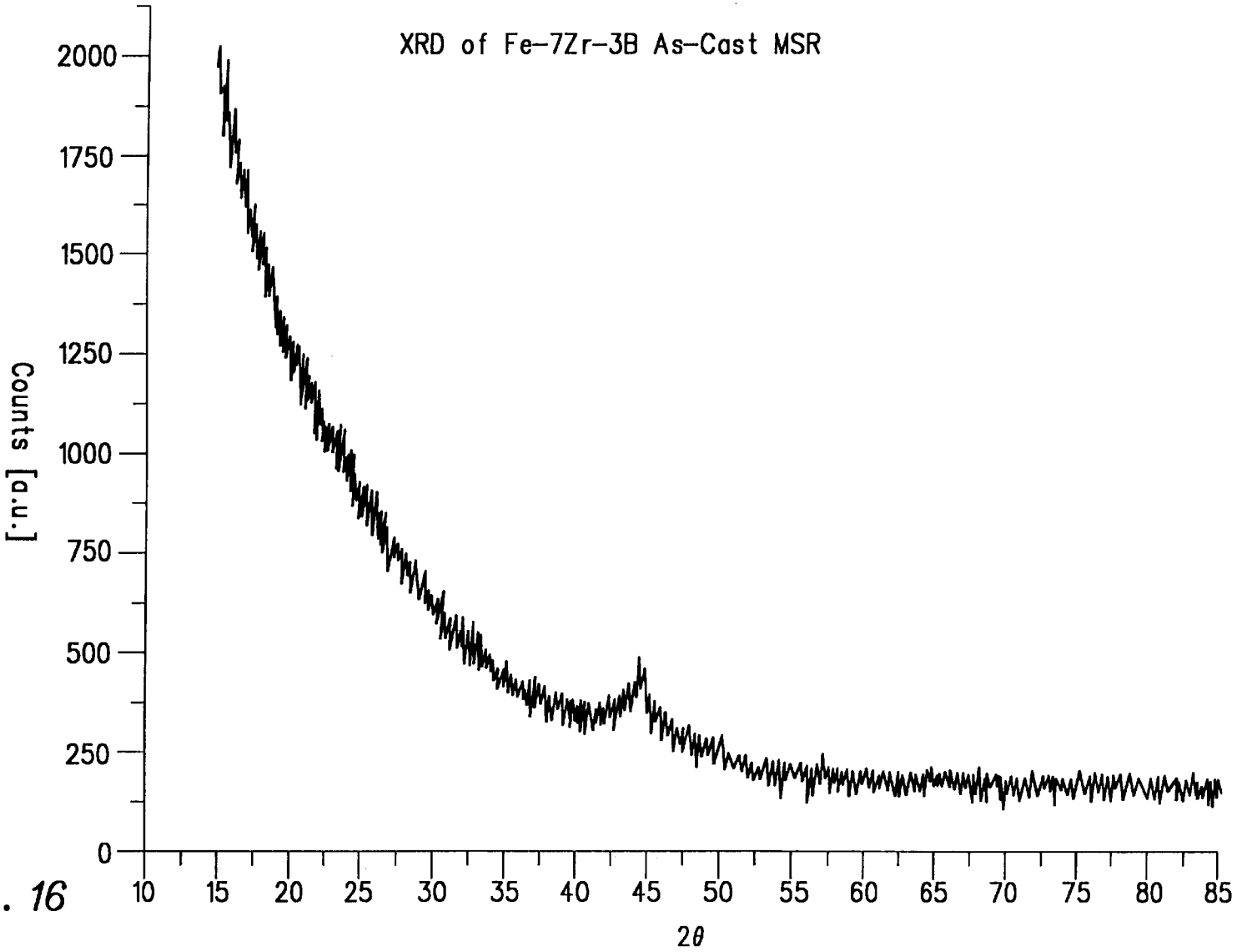
FIG. 16 illustrates an XRD pattern of an Fe—7Nb—9B as-cast MSR sample, representing an embodiment of the present inventions.
Figure 17:
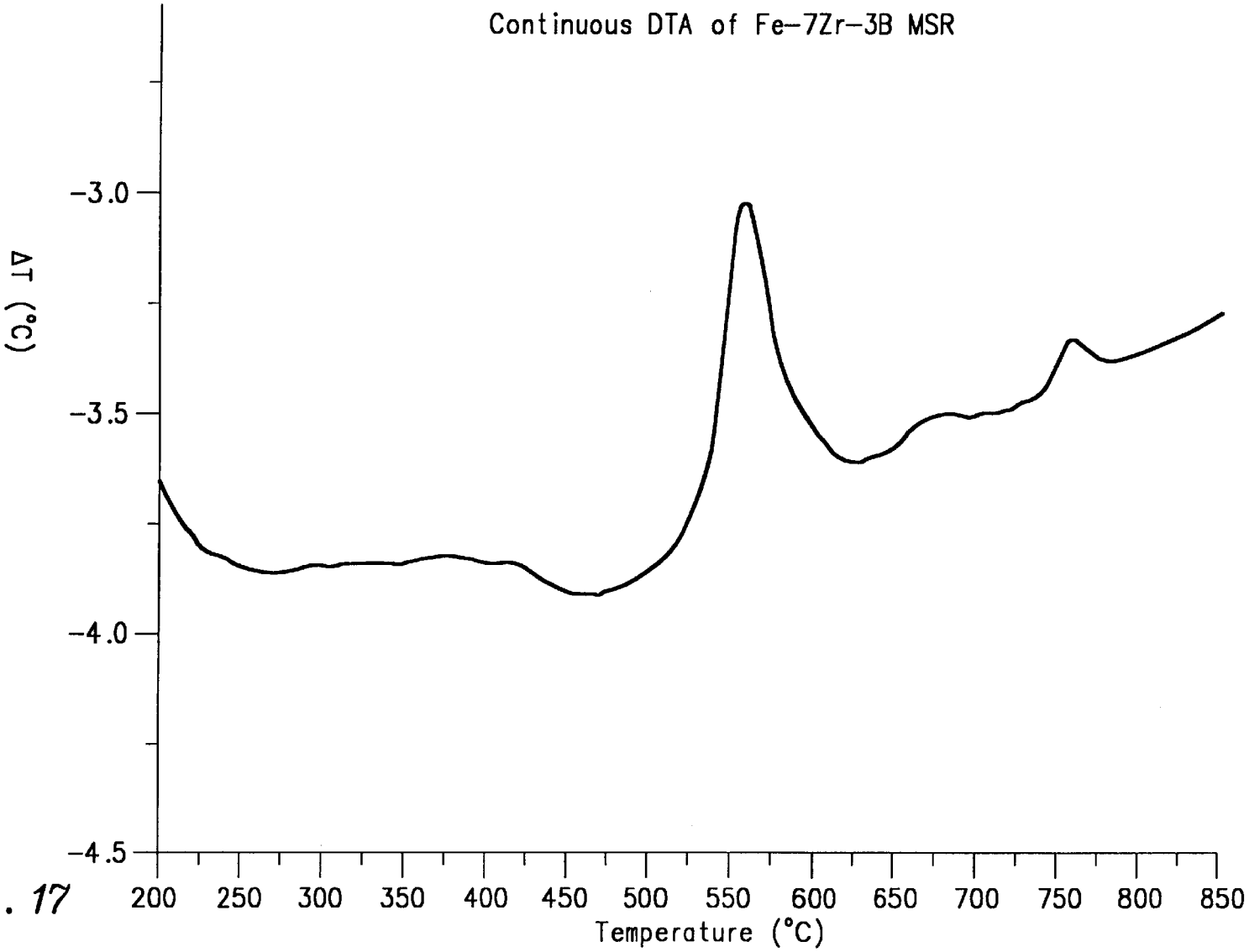
FIG. 17 illustrates a continuous DTA thermogram of an Fe—7Zr—3B MSR sample, representing an embodiment of the present inventions.
Figure 18:
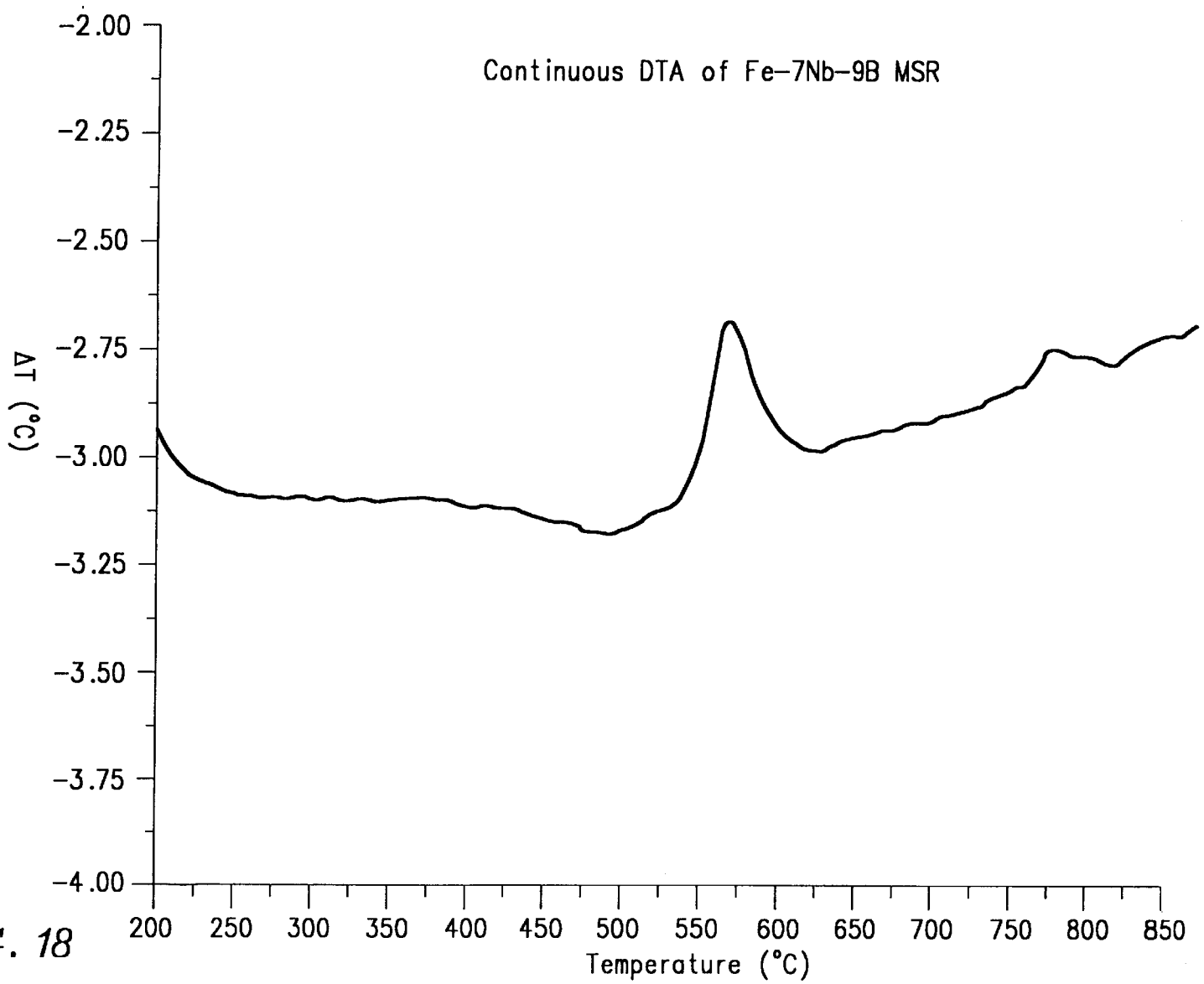
FIG. 18 illustrates a continuous DTA thermogram of an Fe—7Nb—9B MSR sample, representing an embodiment of the present inventions.
Figure 19:
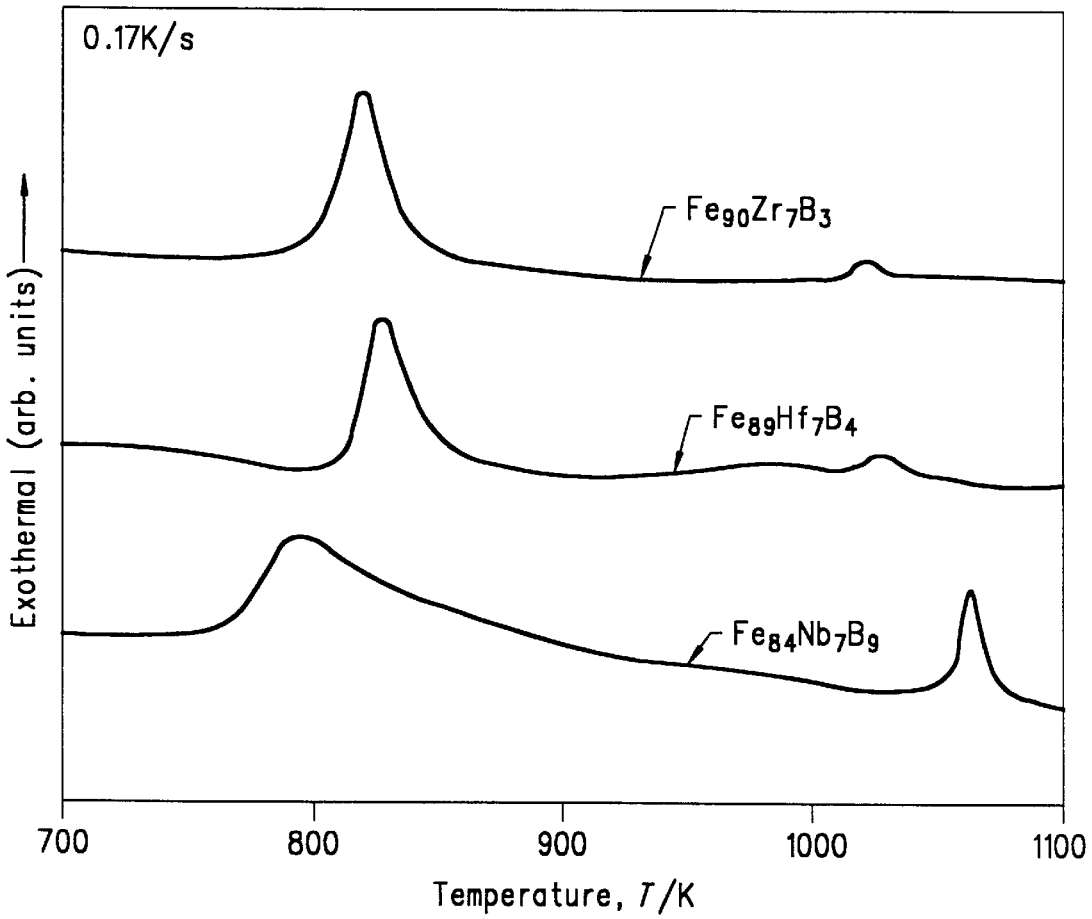
FIG. 19 PRIOR ART
FIG. 19 illustrates a continuous DTA thermogram of an Fe—7Zr—3B and Fe—7Nb—9B as-cast MSR, as reported in the literature [66].

FIGS. 15–16 summarize x-ray some diffraction results for melt spun Fe—7Zr—3B and Fe—7Nb—9B alloys. In both cases, a broad amorphous scattering maximum is apparent at about 45°. To examine the thermal stability, pieces of the melt spun ribbon were mixed with $Al_2O_3$ powder and heated at a rate of 20° C./min in accordance with differential thermal analysis (DTA). The thermal response of the Fe—72r-3B and Fe—7Nb—9B alloy samples is given in FIGS. 17–18. The differential thermal analysis data shown on FIGS. 17–18 compares well with results reported in the literature [66].

A microstructure comprising nanocrystals of Fe separated from each other by an intragranular amorphous phase provides for a magnetic coupling that is essential for optimum soft magnetic properties. A method that promotes an additional nucleation density will act to limit the grain size, yield a finer nanocrystal size with a higher number density for the same volume fraction, and yield a further improvement in soft magnetic properties.

The following are estimates of the behavior of some embodiments of the invention. The magnetic flux density ($B_s$) may exceed the range of approximately 1.2–1.5ST (where T stands for Tesla). The effective permeability ($\mu_6$) at 1 kHz may exceed the range of approximately $1.5–2.0\times10^4$. The coercivity ($H_c$) may be in the range of approximately 5–8 A/m. This kind of soft magnetic performance is useful for devices such as, for example, transformers, inductors, and magnetic recording heads.

Figure 20:
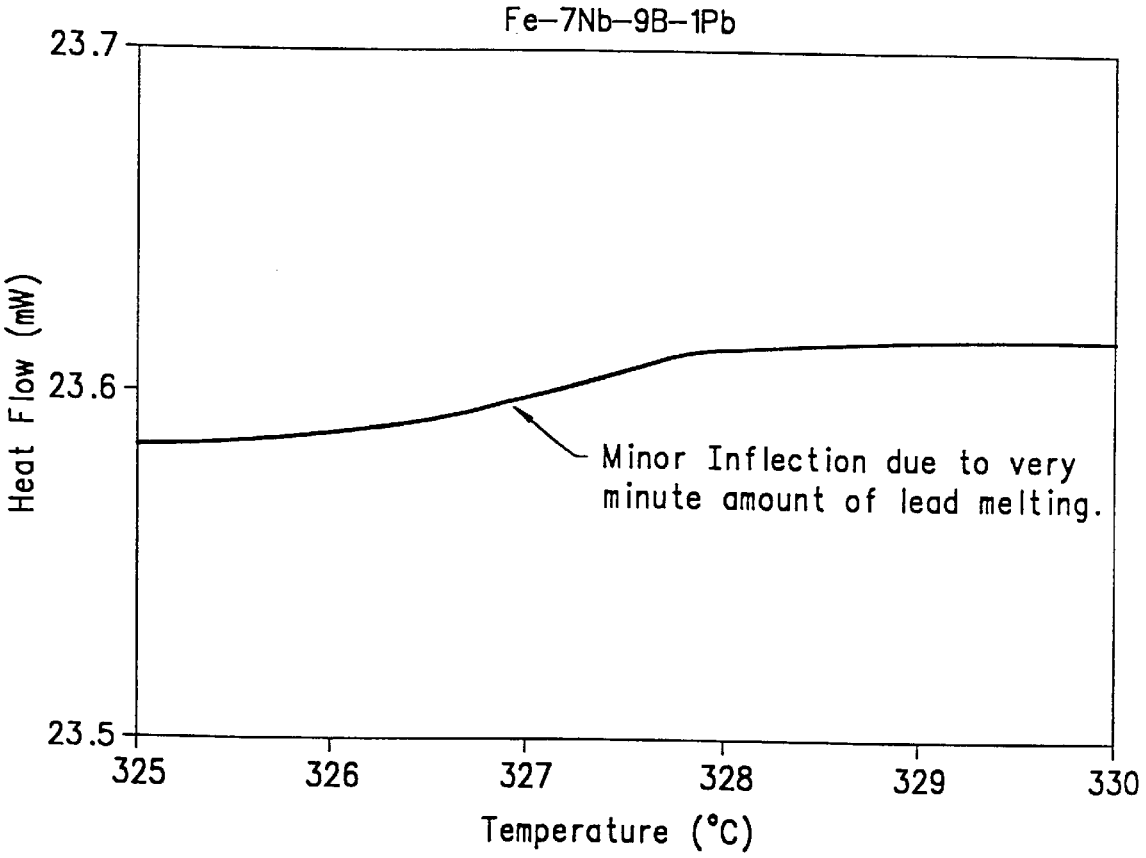
FIG. 20 illustrates a differential scanning calorimetry (DSC) trace of an Fe—7Nb—9 B—1Pb sample, representing an embodiment of the present invention.
Figure 21:
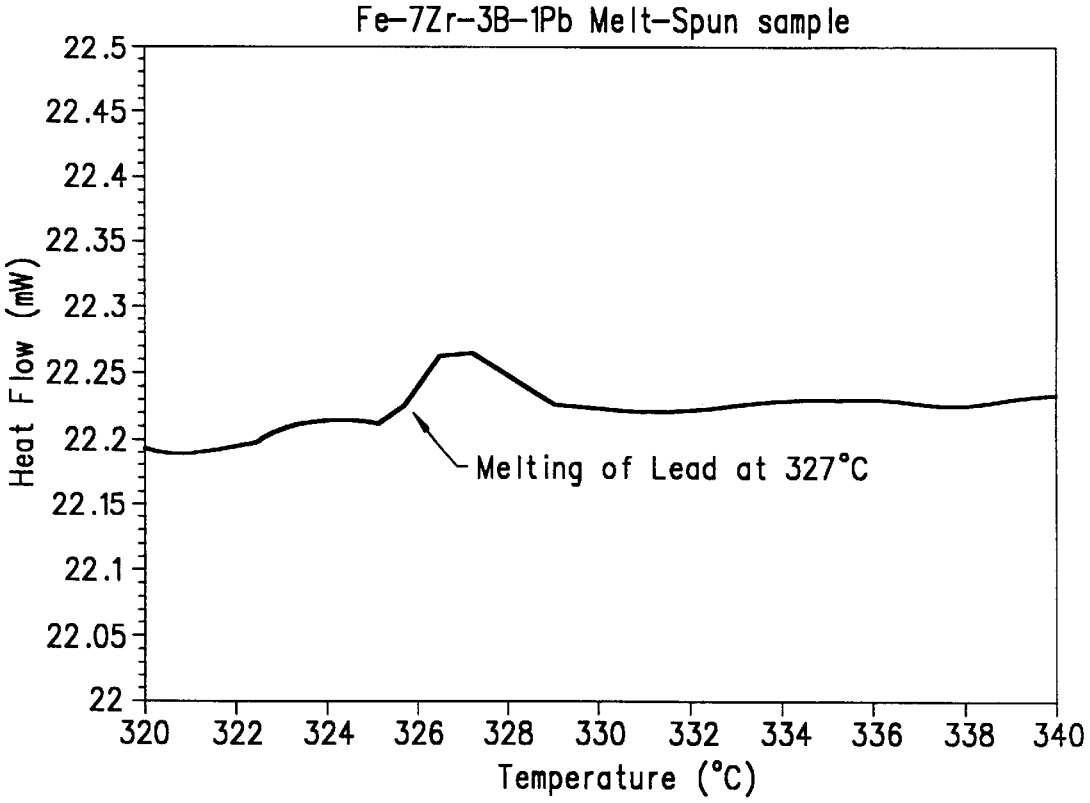
FIG. 21 illustrates a differential scanning calorimetry trace of an Fe—7Zr—3B—1Pb melt-spun sample, representing an embodiment of the present invention.

Referring to FIGS. 20–21, differential scanning calorimetry traces of two iron-based alloys according to the invention are depicted. FIG. 20 illustrates a differential scanning calorimetry trace from an Fe—7Nb—9B—1P alloy that was lead deficient. Thus, only a small inflection from the lead is apparent. FIG. 21 illustrates a differential scanning calorimetry trace from an Fe—7Zr—3B—1Pb alloy sample. The Fe—7Zr—3B—1Pb sample was not lead deficient. It can be appreciated that the inflection depicted in FIG. 21 from the melting lead is more pronounced than the inflection from the melting lead depicted in FIG. 20 since there was relatively more lead in the sample used to obtain the results depicted in FIG. 21.

Practical Applications of the Invention

A practical application of the present invention which has value within the technological arts is the preparation of aluminum based amorphous alloys for use in sports equipment as well as for aerospace applications. Aluminum based alloys according to the invention can be used in golf clubs, tennis rackets, and bicycles, or the like. Another practical application of the invention is the preparation of iron based amorphous alloys for use in transformers and permanent magnets. There are virtually innumerable uses for the present invention, all of which need not be detailed here.

All the disclosed embodiments of the invention described herein can be realized and practiced without undue experimentation. Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. Accordingly, it will be appreciated by those skilled in the art that the invention may be practiced otherwise than as specifically described herein.

For example, the individual components need not be combined in the disclosed amounts, or introduced in the disclosed sequence, but could be provided in virtually any amounts, and introduced in virtually any sequence. Further, the individual components need not be derived from the disclosed materials, but could be derived from virtually any suitable precursor materials. Further, although the alloy described herein is capable of existing as a physically separate material; it will be manifest that the alloy can be integrated into the apparatus with which it is associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

REFERENCES

1. U. Köster and U. Schünemann, *Rapidly Solidified Alloys: Process, Structures, Properties, and Applications,* p. 303, ed. by H. H. Liebermann, Marcel Dekker, NY, (1993).
2. A. R. Yavari and O. Drbohlav, *Mat. Trans. JIM* 36, 896 (1995).
3. K. Nakazato, Y. Kawamura, A. P. Tsal, A. Inoue, *Appl. Phys. Lett.* 63, 2644 (1993).
4. Y. He, S. J. Poon and G. J. Shiflet, *Science* 241, 1640 (1988).
5. L. Battezzati, M. Baricco, P. Schumacher, W. C. Shih, and A. L. Greer, *Mat. Sci. and Eng.* A1791180, 600 (1994).
6. A. Inoue, K. Nakazato, Y. Kawamura, A. P. Tsal and T. Masumoto, *Mater. Trans. JIM* 35, 95 (1994).
7. A. P. Tsai, T. Kamiyama, Y. Kawamura, A. Inoue and T. Masumoto, *Acta Materialia* 45, 1477 (1997).
8. D. Tumbull, *Metall. Trans.* 12A, 695 (1981).
9. J. C. Foley, D. R. Allen and J. H. Perezko, "Analysis of Nanocrystal Development In Al—Y—Fe and Al—Sm Glasses", *Scripta Materalia,* Vol. 35, No. 5, pp. 655–660, 1996.
10. R. Kampmann, Th Ebel, M. Haese, and R. Wagner, *Phys. Stat. Sol.* (b) 172,295 (1992).
11. J. C. Foley and J. H. Perepezko, *Journal of Non-Crystalline Solids,* 205–207, 559 (1996).

12. J. H. Pereo, *Mater. Sci. and Eng.* 65A, 125 (1984).
13. H. Hseih, B. H. Toby, T. Egami, Y. He, S. J. Poon, and G. J. Shiflet, *J. Mater. Res.* 5,2807 (1990).
14. W. A. Johnson and R. F. MehI, *Trans. AIME* 135,416 (1939).
15. M. Avrai, *J. Chem. Phys.* 7,1103 (1939).
16. A N. Kolmogorov, *Bull. Acad. Sd. USSR* 3, 355 (1937).
17. F. S. Ham, *J. Phys. Chem. Solids* 6,335 (1958).
18. J. W. Chrisfian, *The Theory of Transformations in Metals and Alloys* (2nd ed.), Oxford, New York, Pergamon Press, 540 (1965).
19. D. E. Coates, *Metall Trans.* 3A, 1203 (1972).
20. D. E. Coates, *Metall Trans.* 4A, 1077 (1973).
21. K. Hono, Y. Zhang, A. Inoue, and T. Sakural, *Mat. Trans. JIM* 36, 909 (1995).
22. J. C. Foley, Ph.D. Thesis, University of Wisconsin—Madison (1997).
23. A. V. Wagner and F. Spaepen, *Mat. Sci. and Eng. A*179IA180, 265 (1994).
24. P. A. Duine, J. Sietsma and A. van den Beukel, *Phys. Rev. B* 48,6957 (1993).
25. A. Witvrouw, Ph.D. Thesis, Harvard University, (1993).
26. A. L. Greer, *Rapidly Solidified Alloys: Processes, Structures, Properties, and Applications,* p.269, ed. by H. H. Liebermann, Mercel Dekker, NY, (1993).
27. F. C. Frank, *Proc. Royal Soc.* A 201, 586 (1950).
28. G. W. Greenwood, *Acta Metall.* 4,243 (1956).
29. A. Inoue, T. Zhang, and T. Masumoto, *J. Non-Cryst. Solids* 156–158, 473 (1993).
30. A. Inoue, "High Strength Bulk Amorphous Alloys with Low Critical Cooling Rates" (Overview), *Materials Transactions JIM,* Vol. 36, No. 7 (1995), pp. 866–875.
31. O. Redlich and A T. Kister, *Ind Eng. Chem.* 40,345 (1948).
32. A T. Dinsdale, *Calphad* 15,317 (1991).
33. N. Saunders, A P. Miodownik, and A T. Dinsdale, *Calphad* 12, 351 (1988).
34. A. F. Guillermet and M. Hillert, *Calphad* 12, 337 (1988).
35. L. Kaufinan and H. Nesor, *Zeitschnfifur Metalikunde* 64, 249 (1973).
36. G. M. Ryss, A. I. Stronganov, Yu. O. Esin, and P. V. *Gel'd, Zhurnal Fizicheskoi Khimii* 50, 771 (1976) [in English: *Russian Journal of Phys. Chem.* 50, 454 (1976)].
37. G. M. Ryss, A. I. Stronganov, Yu. O. Esin, and P. V. Gel'd, *Zhurnal Fizicheskoi Khimii* 50, 985 (1976) [in English: *Russian Journal of Phys. Chem.* 50, 578 (1976)].
38. J. L. Murray, *Mat. Res. Soc. Proc.* 19,249 (1983).
39. R. E. Watson and L. H. Bennett, *Calphad* 8, 307 (1984).
40. J. C. Foley, J. H. Perepezko, "Formation of Nanocrystalline Aluminum in Al—Y—FE Amorphous Alloys", *Materials Science Forum,* Vols. 225–227 (1996) pp. 323–328.
41. Y. H. Kim, A. Inoue, and T. Masumoto, *Mat. Trans. JIM* 32, 331 (1991).
42. A. Inoue, A. Takeuchi, A. Makino, and T. Masumoto, *Mat. Trans. JIM* 36, 962 (1995).
43. A. Inoue, A. Takeuchi, A. Makino, and T. Masumoto, *Mat. Trans. JIM* 36, 676 (1995).
44. Engineered Materials Handbook, Desk Edition, ASM International, (Michelle M. Gauthier et al. eds., 1995).
45. D. L. Zhang and B. Cantor, "Heterogeneous Nucleation of In particles Embedded in an Al matrix", *Philosophical Magazine* A 62, (1990) 557.
46. K. I. Moore, D. L. Zhang, and B. Cantor, "Solidification Pb Particles Embedded in Al", *Acta Metallurgica et Materialia* 38, (19) 1327.
47. J. C. Foley, D. R Allen and J. H. Perezko, "Analysis of Nanocrystal Development In Al—Y—Fe and Al—Sm Glasses", *Scripta Materalia,* Vol. 35, No. 5, pp. 655–660, 1996.
48. K. S. Yeum, R. Speiser, and D. R. Poirier, "Estimation of the Surface Tensions of Binary Liquid Alloys", *Metallurgical Transactions* B, Vol. 20B, pp. 693–703.
49. Y. He, G. M. Dougherty, G. J. Shiflet and S. J. Poon, "Unique Metallic Glass Formability and Ultra-High Tensile Strength in Al—Ni—Fe—Gd Alloys", *Acta Metallurgica et Materialia* Vol. 41, No. 2, pp. 337–343, 1993.
50. A. Inoue and T. Masumoto, "Light-metal Base Amorphous Alloys Containing Lanthanide Metal", *Journal of Alloys and Compounds,* pp. 340–348 (1994).
51. A. Makino and K Suzuki, "Magnetic Properties and Core Losses of Nanocrystalline Fe-M-B (M/Zr, Hf or Nb) Alloys", *Materials Science and Engineering,* pp. 127–131, (1994).
52. K. Higashe, T. Mukai, S. Tanimura, A. Inoue, T. Masumoto and K. Ohtera, "Very Fine Grains and Very High Strain Rate Superplasticity in Aluminum-Based Alloys Produced from Amorphous Powders", *Materials Science Forum* Vols. 113–115 (1993) pp. 231–236.
53. T. Masumoto, "Recent Progress of Amorphous Metallic Materials", *Sci. Rep. No.* 2, (1994) pp. 91–102.
54. J. A. Diego, M .T. Clavaguera-Mora, and N. Clavaguera, "Thermodynamic, Kinetic and Structural Mechanisms Controlling the Formation of Nanocrystalline Nd—Fe—B Materials", *Materials Science and* Engineering, (1994) pp. 526–530.
55. G. S. Choi, Y. H. Kim, H. K Cho, A. Inoue, and T. Masumoto, "Ultrahigh Tensile Strength of Amorphous Al—Ni(Nd,Gd)—Fe Alloys Containing Nanocrystalline Al Particles", *Scripta Metallurgica et Materialia,* Vol. 33, No. 8, pp. 1301–1306, 1995.
56. A. Inoue and J. Gook, "Fe-Based Ferromagnetic Glassy Alloys with Wide Spread Supercooled Liquid Region", *Materials Transactions,* Vol, 36, No. 9, (1995), pp. 1180–1183.
57. U. Köster and U. Schünemann, "Phase Transformations in Rapidly Solidified Alloys", *Materials Engineering,* pp. 309–315.
58. T. Iida and R. Guthrie, "The Physical Properties of Liquid Metals", Oxford University Press, (1988), pp. 134–146.
59. K. Suzuki, M. Kikuchi, A. Makino, A. Inoue and T. Masumoto, "Changes in Microstructure and Soft Magnetic Properties of an $Fe_{86}Zr_7B_6Cu_1$ Amorphous Alloy upon Crystallization", *Materials Transactions JIM,* Vol. 32, No. 10 (1991), pp. 961–968.
60. A. Makino, K. Suzuki, A. Inoue, and T. Masumoto, "Low Core Loss of a bcc $Fe_{86}Zr_7B_6Cu_1$ Alloy with Nanoscale Grain Size", *Materials Transactions JIM,* Vol. 32, No. 6 (1991), pp. 551–556.
61. A. Inoue, "Nanocrystalline Soft Magnetic Alloys with Zero Magnetostrict Ion in Fe—Zr—Al and Fe—Zr—Si Base Systems", *Material Science Forum,* 225–227, p. 639 (1996).
62. K. Müller, M. Von Heimendahl, "TEM Investigation of Crystallization Phenomena in the Metallic Glass Vitrovac7 0040 ($Fe_{40}Ni_{40}N_{40}B_{20}$), *Journal of Materials Science,* 17 (1982) pp. 2525–2532.
63. R. Tiwari, S. Ranganathan, M. Heimendahl, "TEM of the Kinetics of Crystallization of Metglas7 2826, *Eingegangen am* 9. (1981), pp. 563–568.
64. L. Battezzati, C. Antonione, G. Riontino, "Kinetics of Formation and Thermal Stability of Fe-X-B Metallic Glasses", *Journal of Non-Crystalline Solids* 89 (1987) pp. 114–130.
65. A. Inoue, Y. Miyauchi, A. Makino, and T. Masumoto, "Microstructure and Soft Magnetic Properties of Nanocrystalline Fe—Zr—B—Al, Fe—Zr—B—Si and Fe—Zr—B—Al—Si Alloys with Zero Magnetostriction", *Materials Transactions, JIM,* Vol. 37, No. 1 (1996), pp. 78–88.

66. A. Makino, A. Inoue and T. Masumoto, *Materials Transactions, JIM,* Vol. 36, No. 7 (1995), pp. 924–938.

What is claimed is:

1. A nanocrystal dispersed amorphous alloy composition comprising:

aluminum;

at least one transition metal;

at least one rare earth element;

at least one crystallization agent that is immiscible in an amorphous precursor mixture of said aluminum, said at least one transition metal, and said at least one rare earth element, and at least one element selected from the group consisting of tin and calcium.

2. A nanocrystal dispersed amorphous alloy composition comprising:

aluminum;

at least one transition metal;

at least one rare earth element; and at least one crystallization agent that is immiscible in an amorphous precursor mixture of said aluminum, said at least one transition metal, and said at least one rare earth element, wherein said at least one crystallization agent includes at least one element selected from the group consisting of lead, bismuth, indium, and cadmium.

3. A nanocrystal dispersed amorphous alloy composition comprising:

iron;

at least one transition metal;

boron;

at least one crystallization agent that is immiscible in an amorphous precursor mixture of said iron, said at least one transition metal, and said boron; and a flux.

4. A nanocrystal dispersed amorphous alloy composition comprising:

iron;

at least one transition metal:

boron;

at least one crystallization agent that is immiscible in an amorphous precursor mixture of said iron, said at least one transition metal, and said boron; and a flux including at least one element selected from the group consisting of phosphorous, and carbon.

5. A nanocrystal dispersed amorphous alloy composition comprising:

iron;

neodymium;

boron;

at least one crystallization agent that is immiscible in an amorphous precursor mixture of said iron, said neodymium and said boron, and a flux.

6. A nanocrystal dispersed amorphous alloy composition comprising:

iron;

neodymium;

boron;

at least one crystallization agent that is immiscible in an amorphous precursor mixture of said iron, said neodymium and said boron, and a flux including phosphorous.

7. A nanocrystal dispersed amorphous alloy composition comprising:

iron:

neodymium;

boron;

at least one crystallization agent that is immiscible in an amorphous precursor mixture of said iron, said neodymium and said boron, and a flux including phosphorous, and wherein said boron is present in an amount of from approximately 1 at. % to approximately 8 at. %.

* * * * *